US010156420B2

(12) United States Patent
Huang et al.

(10) Patent No.: US 10,156,420 B2
(45) **Date of Patent: *Dec. 18, 2018**

(54) RECEIVER AND COLLAPSIBLE STOCK FOR A FIREARM

(71) Applicants: George Huang, Henderson, NV (US); Jeffrey S. Cross, Lexington, TN (US)

(72) Inventors: George Huang, Henderson, NV (US); Jeffrey S. Cross, Lexington, TN (US)

( * ) Notice: Subject to any disclaimer, the term of this patent is extended or adjusted under 35 U.S.C. 154(b) by 42 days.

This patent is subject to a terminal disclaimer.

(21) Appl. No.: 15/437,357

(22) Filed: Feb. 20, 2017

(65) Prior Publication Data

US 2017/0160047 A1 Jun. 8, 2017

Related U.S. Application Data

(63) Continuation of application No. 14/639,913, filed on Mar. 5, 2015, now Pat. No. 9,574,846.

(51) Int. Cl.

| | |
|---|---|
| ***F41C 23/14*** | (2006.01) |
| ***F41C 23/04*** | (2006.01) |
| ***F41A 3/66*** | (2006.01) |
| ***F41C 23/20*** | (2006.01) |

(52) U.S. Cl.

CPC ..... *F41C 23/04* (2013.01); *F41A 3/66* (2013.01); *F41C 23/20* (2013.01)

(58) Field of Classification Search

CPC ..... F41C 23/14; F41C 23/06; F41C 23/04; F41A 3/84; F41A 5/18

USPC ..... 42/71.01–74; 89/191.01

See application file for complete search history.

(56) References Cited

U.S. PATENT DOCUMENTS

| | | | | |
|---|---|---|---|---|
| 3,386,336 A * | 6/1968 | Roy | F41A 3/72 | 42/75.02 |
| 3,688,641 A * | 9/1972 | Curtis | F41A 3/72 | 89/189 |
| 3,960,053 A * | 6/1976 | Conley | F41A 3/70 | 89/149 |
| 4,416,186 A * | 11/1983 | Sullivan | F41A 3/26 | 89/198 |
| 8,051,593 B2 * | 11/2011 | Vesligai | F41C 23/04 | 42/73 |
| 8,844,185 B2 * | 9/2014 | Jarboe | F41C 23/04 | 42/73 |

(Continued)

*Primary Examiner* — Michael David

(74) *Attorney, Agent, or Firm* — Shaddock Law Group, PC

(57) ABSTRACT

A receiver having an integral stock connector component that extends along the receiver; two extension rod/rail apertures formed through the integral stock connector component, wherein each extension rod/rail aperture is formed so as to slidably receive an extension rod/rail extending from a buttstock, such that each extension rod/rail is slidably movable within one of the extension rod/rail apertures; wherein each extension rod/rail comprises a rod channel and two or more rod dimples/detents formed along the rod channel; and a latch that is movable between an engaged position and a disengaged position, wherein when the latch is in the engaged position, a protrusion portion urges latch elements into the rod/rail apertures a distance that seats the latch elements into the rod dimples/detents, and wherein when the latch is in the disengaged position, the protrusion portion allows the latch elements to retract from the rod dimples/detents and into the rod channels.

20 Claims, 24 Drawing Sheets

(56) References Cited

U.S. PATENT DOCUMENTS

| | | | | |
|---|---|---|---|---|
| 8,850,735 | B2 * | 10/2014 | Kenney | F41A 3/66 42/106 |
| 8,950,097 | B2 * | 2/2015 | Sugg | F41A 3/68 42/16 |
| 9,228,795 | B1 * | 1/2016 | Kielsmeier | F41C 23/14 |
| 9,347,739 | B2 * | 5/2016 | Gomirato | F41C 23/04 |
| 9,404,708 | B1 * | 8/2016 | Chow | F41C 23/06 |
| 2007/0261284 | A1 * | 11/2007 | Keng | F41C 23/04 42/73 |
| 2010/0275489 | A1 * | 11/2010 | Cabahug | F41C 23/04 42/71.01 |
| 2010/0307042 | A1 * | 12/2010 | Jarboe | F41A 3/18 42/6 |
| 2011/0283585 | A1 * | 11/2011 | Cabahug | F41C 23/22 42/73 |
| 2012/0151813 | A1 * | 6/2012 | Brown | F41C 7/00 42/73 |
| 2014/0190056 | A1 * | 7/2014 | Troy | F41C 23/14 42/71.01 |
| 2014/0260946 | A1 * | 9/2014 | Gomez | F41A 5/18 89/191.01 |
| 2016/0033219 | A1 * | 2/2016 | Meier | F41A 3/66 89/191.01 |
| 2016/0187099 | A1 * | 6/2016 | Cottle | F41C 23/14 42/73 |

* cited by examiner

RECEIVER AND COLLAPSIBLE STOCK FOR A FIREARM

CROSS-REFERENCE TO RELATED APPLICATIONS

This patent application is a Continuation of U.S. patent application Ser. No. 14/639,913, filed Mar. 5, 2015, now U.S. Pat. No. 9,574,846, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present invention relates to a lower receiver for a firearm and an associated collapsible buttstock.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms utilize a variable position buttstock 2 that is slidable and lockable at various positions along a buffer tube 5. A typical variable position buttstock 2 can be locked into a collapsed position, as illustrated in FIG. 1, or locked into a fully extended position, as illustrated in FIG. 2.

As further illustrated in FIGS. 3 and 4, the typical buffer tube 2 includes a capped cylindrical portion having a threaded portion 8 for installation into a firearm receiver. Typically, an endplate 6 and a lock ring 4 are utilized to complete installation of the buffer tube on the receiver. A key protrusion 7 extends from the cylindrical portion 9, typically at the 6 o'clock position. An interior portion of the key protrusion includes a plurality of spaced apart recesses or apertures that interact with a retractable bolt to lock the buttstock 2 in a desired position relative to the buffer tube 5.

Certain retrofit collapsible stock assemblies are available. These assemblies require use of a shortened, proprietary buffer tube and use of a proprietary bolt carrier, which includes a built-in buffer. In order to install these retrofit collapsible stock assemblies, the upper receiver must be attached to the lower receiver and the existing buffer tube and buffer retainer must be removed from the lower receiver. Next, the proprietary bolt carrier must be inserted through the buffer tube attachment aperture. Then, the proprietary bolt carrier, a proprietary buffer spring, and a proprietary stock adapter are appropriately positioned at the rear of the receiver. Once appropriately positioned, the proprietary buffer tube is then affixed to the lower receiver, via the buffer tube attachment aperture, to secure the components to the receiver.

Finally, the stock is attached to the stock adapter.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, the typical buttstock can be relatively heavy and cumbersome. The known locking mechanisms used to lock the buttstock in a desired position along the buffer tube are awkward and difficult to operate.

As discussed above, the current retrofit collapsible stock designs require the removal of the buffer retainer and retainer spring and require the use of a proprietary bolt carrier. Because of the design of the proprietary bolt carrier, once assembled, the upper receiver of the firearm cannot be separated from the lower receiver of the firearm without removing the entire retrofit collapsible stock assembly. Thus, users are not able to separate components of the firearm, in a typical manner, for inspection or cleaning.

Furthermore, the current retrofit collapsible stock designs require use of a large stock adapter. The lower receiver was never designed for use with such a railed, collapsible stock system. Thus, the separate stock adapter adds unnecessary weight and is weaker than the one piece, monolithic integral stock connector component of the present invention.

Additionally, in variations with buttstock's that are slidably attached, via rails, tubes, or rods, to the firearm receiver, the rails, tubes, or rods typically include cut notches at spaced apart locations along the rails, tubes, or rods for allowing the rails, tubes, or rods (and buttstock) to be locked into a desired position relative to the receiver. These cut notches reduce the strength and rigidity of the rails, tubes, or rods, thereby weakening the rails, tubes, or rods, making them prone to bending.

The disadvantages and shortcomings of the prior art are overcome by the features and elements of the receiver and collapsible buttstock of the present invention. The advantages of the present invention are preferably attained by providing, in a first, exemplary, nonlimiting embodiment, a receiver for a firearm and an associated collapsible buttstock. In various exemplary, nonlimiting embodiments, the receiver includes an integral stock connector component that extends along a portion of the receiver and includes two extension rod/rail apertures formed therethrough. Typically, the integral stock connector component extends beyond the buffer tube attachment aperture of the receiver. However, it should be appreciated that the integral stock connector component of the present invention is not so limited and may only extend to the buffer tube attachment aperture of the receiver.

The extension rod/rail apertures are formed parallel to the longitudinal axis of the receiver. In certain exemplary, nonlimiting embodiments, the extension rod/rail apertures are formed outside exterior wall surfaces of the receiver. In other exemplary, nonlimiting embodiments, the extension rod/rail apertures are formed at least partially within receiving channels formed in the adjacent exterior wall surfaces of the receiver. In still other exemplary, nonlimiting embodiments, the extension rod/rail apertures are formed within the integral stock connector component and within the side walls of the receiver.

The extension rod/rail apertures are formed so as to slidably receive the extension rods/rails that extend from the buttstock.

The buttstock assembly comprises a buttstock, a cheek rest, and two extension rods/rails. The buttstock comprises an elongate portion of material extending from a top end to a bottom end. A recessed channel is formed in the top end of the buttstock.

The cheek rest is formed of a substantially inverted "U" or "V" shaped portion of material. The cheek rest is formed so as to be permanently or releasably attached or coupled to the buttstock proximate the top end. When the cheek rest is attached or coupled to the buttstock, the space provided between the recessed channel and the cheek rest provides an aperture that allows the buffer tube to freely slide therethrough. The cheek rest is also formed so as to be positioned above and at least partially around the buffer tube that extends along a portion of the receiver.

Typical cheek rest for current retrofit collapsible stock designs leave a large gap between the buffer tube in the stock so that a user is not presented with a cheek weld. In contrast, the cheek rest provides a cheek weld for the user, whether the buttstock is in a collapsed or extended position.

The extension rods/rails extend from the buttstock and are positioned so as to be aligned with and slidable within the extension rod/rail apertures of the integral stock connector component. In various exemplary embodiments, the extension rods/rails comprise a solid portion of material. Alternatively, the extension rods/rails comprise a hollow or tubular portion of material.

In various exemplary, nonlimiting embodiments, a rod channel is formed along at least a portion of the extension rod. In various exemplary, nonlimiting embodiments, one or more rod dimples/detents are formed along the rod channel. Typically, a rod dimple/detent is formed at each terminating end of the channel and one or more rod dimples/detents are formed along the channel. Each extension rod/rail is a mirror image of the other, such that the number and position of each rod dimple/detent of each extension rod/rail is aligned. In this manner, each rod dimple/detent represents a lockable position of the buttstock relative to the receiver.

Because the majority of the strength of a rod is in the outer perimeter, by utilizing circular dimples/detents that are cut or pressed into the rod, the rod is more structurally sound than a rod having a large, flat cut across the rod.

By utilizing rod dimples/detents and a rod channel, the strength and integrity of the extension rods/rails is maintained and the problems introduced by cut notches in existing collapsible stocks is circumvented.

A latch assembly, comprising a latch, latch springs, latch elements, and a latch cover, is attached or coupled to the integral stock connector component. Through interaction of the latch elements and the rod dimples/detents, the buttstock assembly can be releasably secured at a desired position relative to the receiver.

In certain exemplary, nonlimiting embodiments, the integral stock connector component includes at least one integral stock connector component that extends along a portion of the receiver such that at least a portion of the extension rod/rail apertures are formed proximate the buffer tube aperture. Alternatively, the integral stock connector component may extend from the receiver such that at least a portion of the extension rod/rail aperture is formed below the buffer tube aperture.

In still other exemplary, nonlimiting embodiments, the integral stock connector component comprises at least one integral stock connector component that is formed so as to extend from an upper receiver.

Accordingly, the presently disclosed invention provides a receiver and collapsible buttstock that allow a user to readily adjust the overall length of the buttstock assembly relative to the receiver, within a determined parameter.

The presently disclosed invention separately provides a receiver and collapsible buttstock that allow a user to readily adjust the overall length of the receiver and collapsible buttstock, using a relatively simple motion that is simplified relative to the current motions necessary to adjust the position of a collapsible buttstock.

The presently disclosed invention separately provides a receiver and collapsible buttstock that utilizes channels and detents that maintain the strength and integrity of the extension rods/rails and the buttstock assembly.

The presently disclosed invention separately provides a receiver and collapsible buttstock that provides increased strength and rigidity when compared to known retrofit collapsible stock designs, particularly those with a "screw-on" stock adapter.

The presently disclosed invention separately provides a receiver and collapsible buttstock that can be easily manipulated by a user.

The presently disclosed invention separately provides a receiver and collapsible buttstock that includes a locking feature with a smooth, ball bearing-type mechanism.

The presently disclosed invention separately provides a receiver and collapsible buttstock that includes a strategically positioned locking mechanism that is ambidextrous and can be operated in a single movement/motion as a user grabs the stock and engages the locking mechanism to unlock and extend the buttstock.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

Any benefits, advantages, or solutions to problems that are described herein with regard to specific embodiments are not intended to be construed as a critical, required, or essential feature(s) or element(s) of the present invention or the claims.

BRIEF DESCRIPTION OF THE SEVERAL VIEWS OF THE DRAWINGS

As required, detailed exemplary embodiments of the present invention are disclosed herein; however, it is to be understood that the disclosed embodiments are merely exemplary of the invention that may be embodied in various and alternative forms, within the scope of the present invention. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

Figure 1:
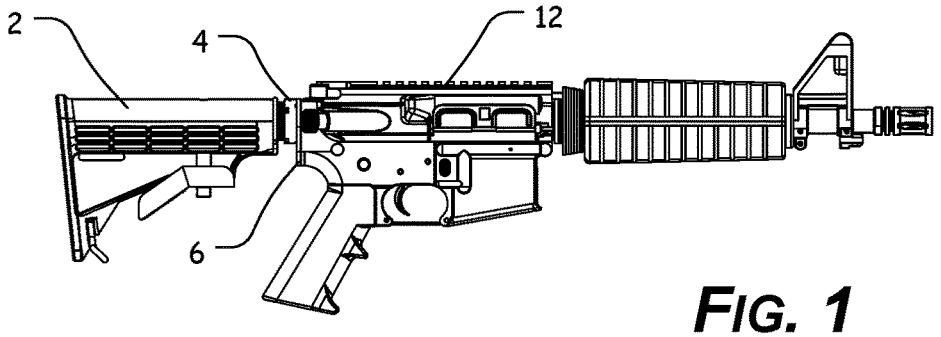
FIG. 1 PRIOR ART
FIG. 1 illustrates a side view of a standard, AR-15 or M4 style rifle having a collapsible buttstock, shown in a collapsed position relative to a buffer tube.
Figure 2:
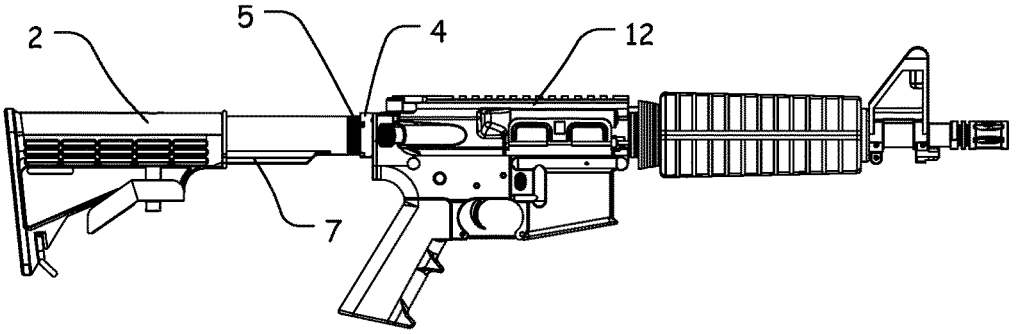
FIG. 2 PRIOR ART
FIG. 2 illustrates a side view of a standard, AR-15 or M4 style rifle having a collapsible buttstock, shown in an extended position relative to a buffer tube.
Figure 3:
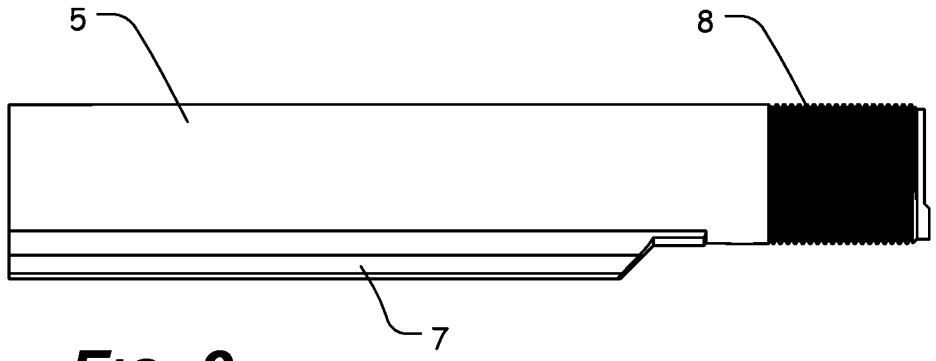
FIG. 3 PRIOR ART
FIG. 3 illustrates a side view of a standard buffer tube.
Figure 4:
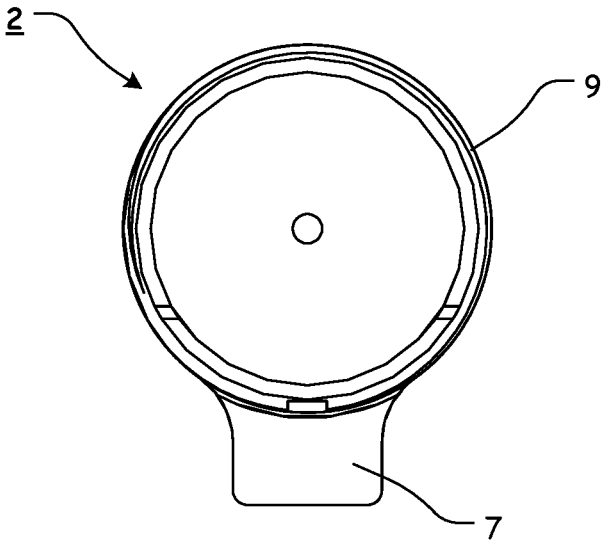
FIG. 4 PRIOR ART
FIG. 4 illustrates a front view of a standard buffer tube.
Figure 5:
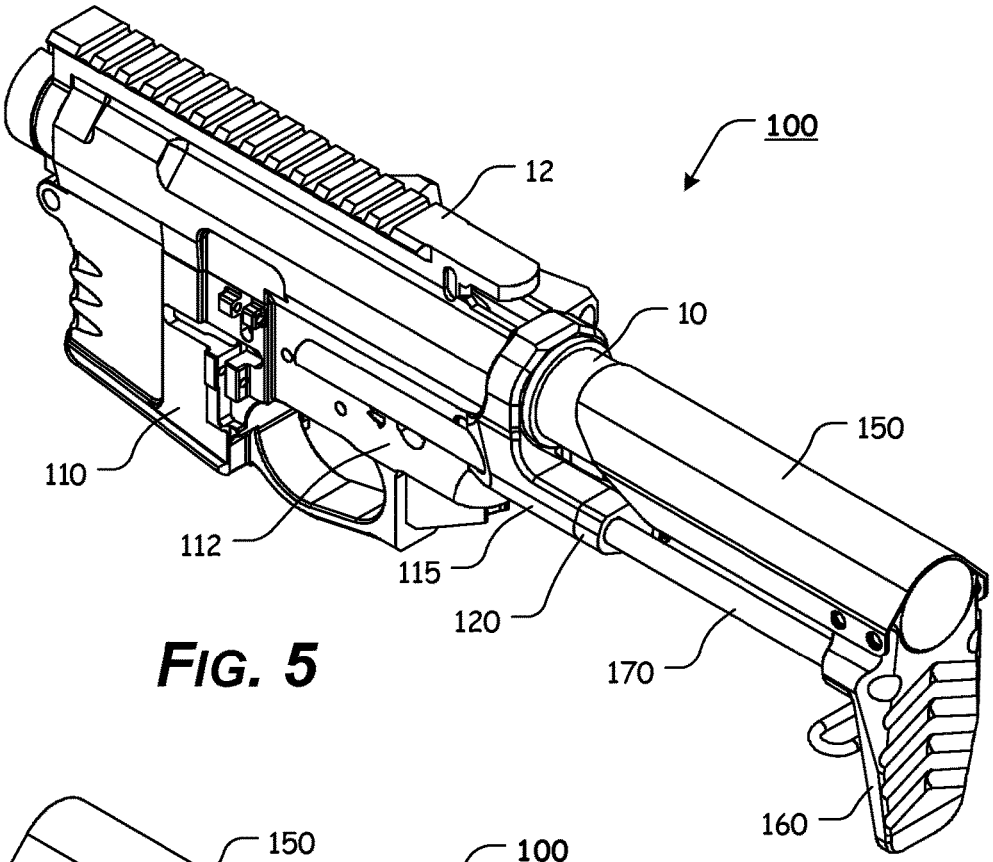
FIG. 5 illustrates an upper, left, rear perspective view of a first exemplary embodiment of a receiver and collapsible buttstock being assembled together with an upper receiver and buffer tube, according to this invention.
Figure 6:
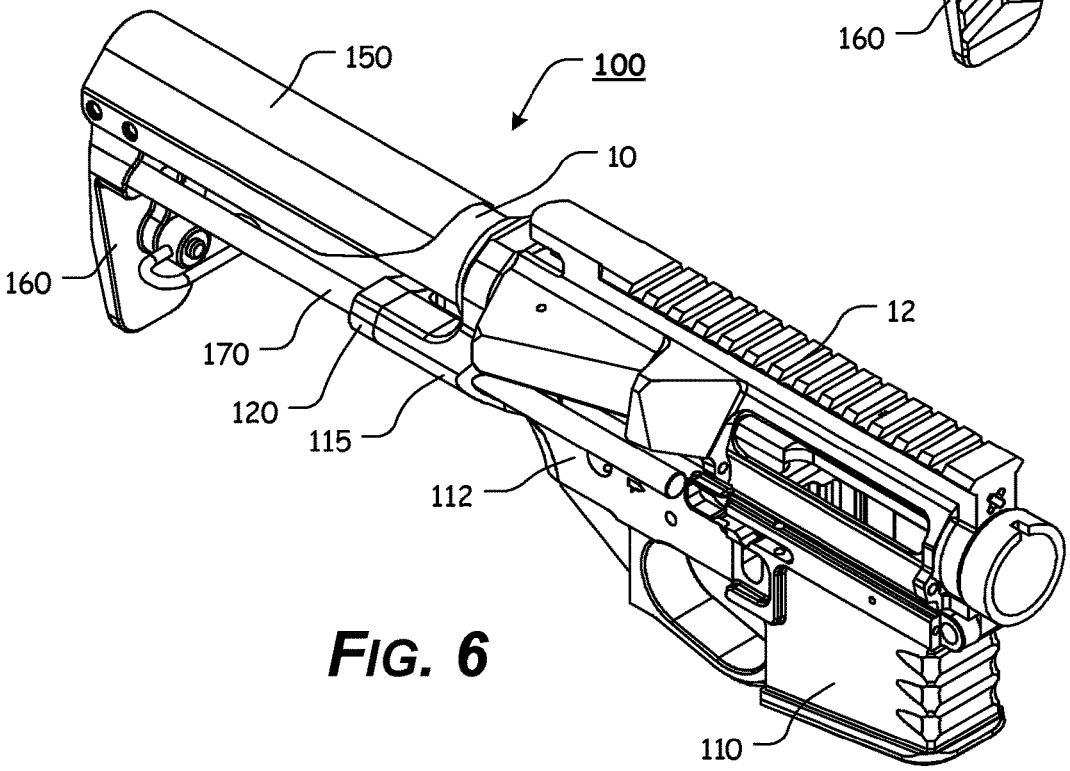
FIG. 6 illustrates an upper, right, front perspective view of a first exemplary embodiment of a receiver and collapsible buttstock being assembled together with an upper receiver and buffer tube, according to this invention.
Figure 7:
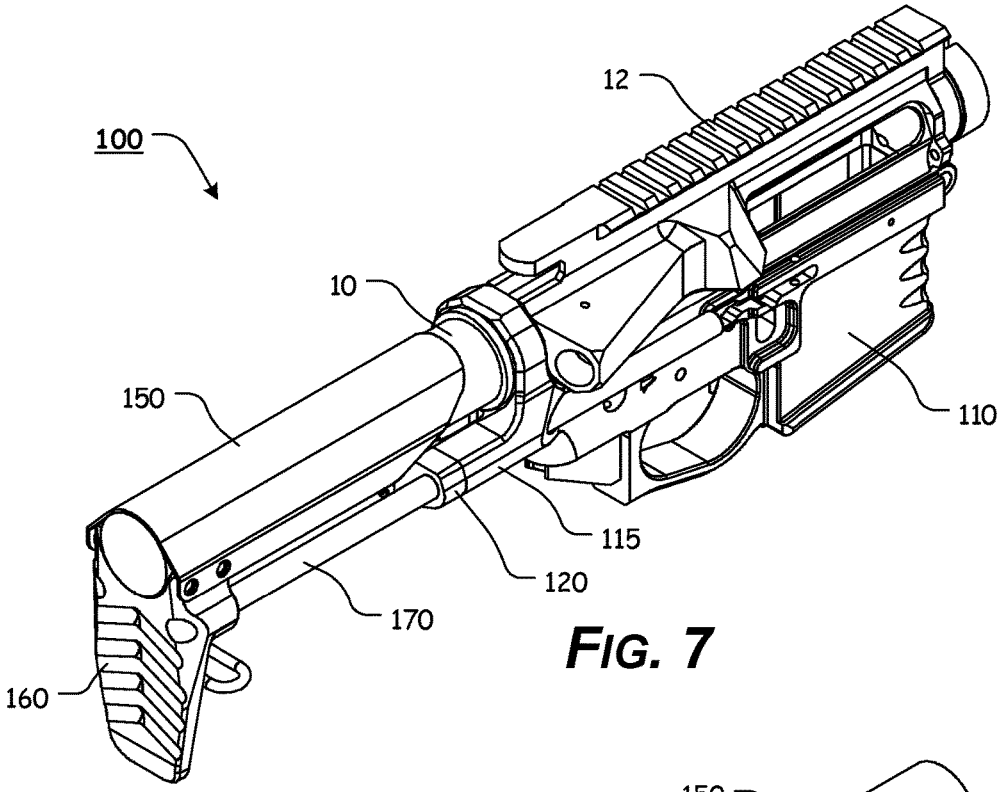
FIG. 7 illustrates an upper, right, rear perspective view of a first exemplary embodiment of a receiver and collapsible buttstock being assembled together with an upper receiver and buffer tube, according to this invention.
Figure 8:
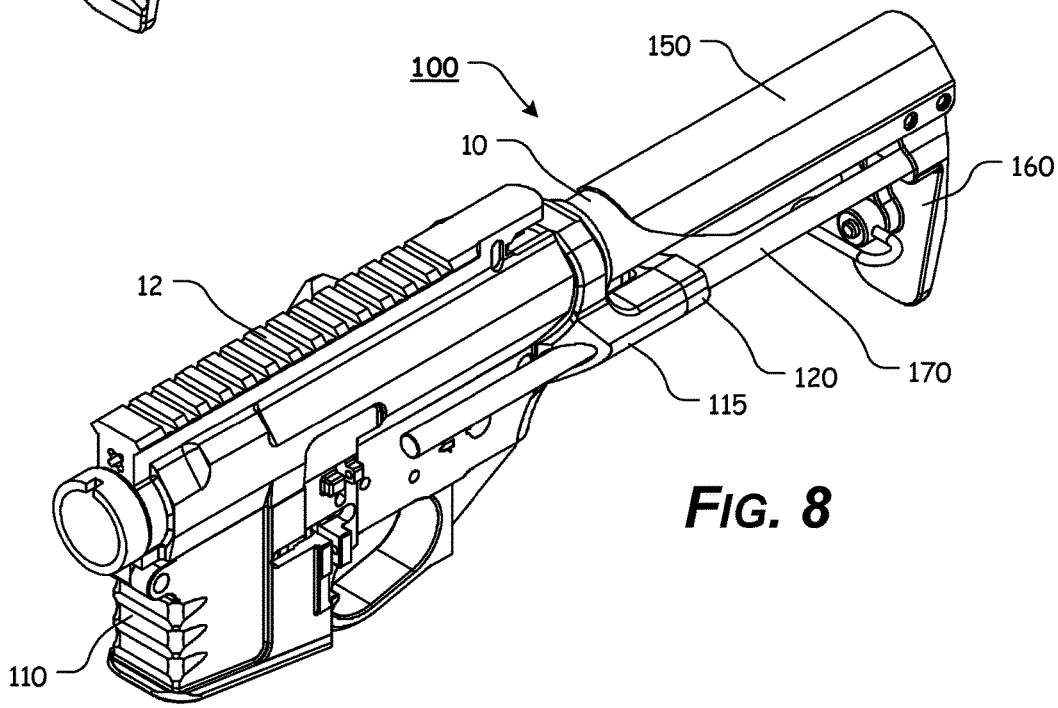
FIG. 8 illustrates an upper, left, front perspective view of a first exemplary embodiment of a receiver and collapsible buttstock being assembled together with an upper receiver and buffer tube, according to this invention.

For simplicity and clarification, the design factors and operating principles of the receiver and collapsible buttstock according to this invention are explained with reference to various exemplary embodiments of a receiver and collapsible buttstock according to this invention. The basic explanation of the design factors and operating principles of the receiver and collapsible buttstock is applicable for the understanding, design, and operation of the receiver and collapsible buttstock of this invention. It should be appreciated that the receiver and collapsible buttstock can be adapted to many applications where a receiver and collapsible buttstock or strap can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "receiver", "integral stock connector component", "collapsible stock", and "firearm" are used for basic explanation and understanding of the operation of the systems, methods, and apparatuses of this invention. Therefore, the terms "receiver", "integral stock connector component", "collapsible stock", and "firearm" are not to be construed as limiting the systems, methods, and apparatuses of this invention. Thus, for example, the term "receiver" is to be understood to broadly include any upper, lower, or combined receiver for a firearm or other similar handheld or shoulder mounted device or tool.

For simplicity and clarification, the receiver and collapsible buttstock of this invention will be described as being used in conjunction with a firearm, such as an AR-15 or M4 style rifle or carbine. However, it should be appreciated that these are merely exemplary embodiments of the receiver and collapsible buttstock and are not to be construed as limiting this invention. Thus, the receiver and collapsible buttstock of this invention may be utilized in conjunction with any firearm or rifle, such as, for example, an AR-10 style rifle, air rifle, paintball marker, Airsoft rifle, replica rifle, or any other tool, device, or object.

Turning now to the drawing FIGS., as discussed above, FIG. 1-4 illustrate various components of known buttstocks and buffer tubes. FIGS. 5-27 illustrate certain elements and/or aspects of a first exemplary embodiment of the receiver and collapsible buttstock 100, according to this invention. In illustrative, non-limiting embodiment(s) of this invention, as illustrated in FIGS. 5-27, the receiver and collapsible buttstock 100 comprises a receiver 110 for a firearm and an associated collapsible buttstock assembly.

As illustrated in FIGS. 5-12 and 20-21, the receiver and collapsible buttstock 100 is illustrated as including an upper receiver 12. It should be appreciated that the upper receiver 12 can be a typical upper receiver for a firearm. It should also be appreciated that a more detailed explanation of the upper receiver 12, the standard features and elements of a receiver that are not related to the present invention, the buffer tube 10, instructions regarding how to assemble the upper receiver 12, the receiver, and the buffer tube 10, and certain other items and/or techniques necessary for the implementation and/or operation of the various exemplary embodiments of the present invention are not provided herein because such elements are commercially available and/or such background information will be known to one of ordinary skill in the art. Therefore, it is believed that the level of description provided herein is sufficient to enable one of ordinary skill in the art to understand and practice the present invention, as described.

As illustrated, the receiver 110 includes an integral stock connector component 115 that extends along a portion of the receiver 110, below the buffer tube aperture. In certain exemplary, nonlimiting embodiments, the integral stock connector component 115 extends rearward, beyond the buffer tube attachment aperture of the receiver 110. However, it should be appreciated that the integral stock connector component 115 of the present invention is not so limited and may only extend as far as the buffer tube attachment aperture of the receiver 110.

Two extension rod/rail apertures 118 are formed through the integral stock connector component 115, substantially parallel to the longitudinal axis $A_{LR}$ of the receiver 110. In certain exemplary, nonlimiting embodiments, the extension rod/rail apertures 118 are formed outside at least a portion of the exterior wall surfaces 112 of the receiver 110. In other exemplary, nonlimiting embodiments, the extension rod/rail apertures 118 are formed at least partially within receiving channels formed in the exterior wall surfaces 112 of the receiver 110. In still other exemplary, nonlimiting embodiments, the extension rod/rail apertures 118 are formed within the integral stock connector component 115 and within the side walls of the receiver 110. Thus, the extension rod/rail apertures 118 may extend only through the integral stock connector component 115, may optionally extend through the integral stock connector component 115 and a portion of the exterior wall surfaces 112 of the receiver 110, or may optionally extend through the integral stock connector component 115 and be maintained within the side walls of the receiver 110.

The extension rod/rail apertures 118 are formed so as to slidably receive the extension rods/rails 170 that extend from the buttstock 160. In this manner, the extension rods/rails 170 are repeatably, slidably movable within the extension rod/rail apertures 118.

Figure 19:
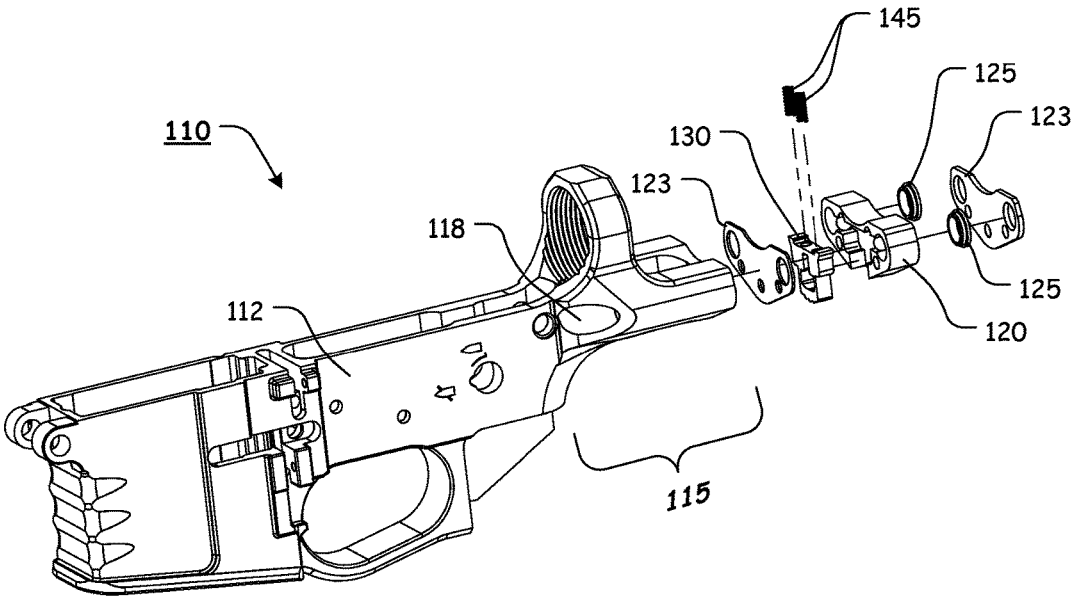
FIG. 19 illustrates an upper, left, perspective, exploded view of a first exemplary embodiment of a receiver, latch, latch cover, attachment screw, and optional elements, according to this invention.

In certain exemplary, nonlimiting embodiments, as illustrated in FIG. 19, the extension rod/rail apertures 118 may be at least partially internally lined with a bushing or liner element 125, comprising a plastic, self-lubricating plastic, or other material to reduce friction between the interior walls of the extension rod/rail apertures 118 and the exterior surface of the extension rods/rails 170.

Additionally, gasket elements 123 may optionally be positioned between certain of the elements, such as, for example, between a rear portion of the integral stock connector component 115 and the latch cover 120 or as a cap over the latch cover 120. The gasket elements 123 may comprise a plastic, self-lubricating plastic, rubber, silicone, metal, carbon fiber, or other material. It should be appreciated that the material used to form the bushing or liner elements 125 and/or the gasket element(s) 123 is a design choice based upon the desired appearance and/or functionality of these elements.

It should also be understood that while the extension rod/rail apertures 118 (and the extension rods/rails 170) are illustrated as having a substantially circular profile, the overall shape and/or profile of the extension rod/rail apertures 118 and the extension rods/rails 170 is a design choice based upon the desired characteristics, functionality, and/or appearance of the extension rod/rail apertures 118 and the extension rods/rails 170. For example, the extension rod/rail apertures 118 and/or the extension rods/rails 170 may have a substantially circular, square, triangular, rectangular, oblong, "L" shaped, "I" shaped, "C" shaped, "V" shaped, "Z" shaped, "T" shaped, or other profile.

Furthermore, in various exemplary embodiments, the extension rods/rails 170 may be formed of a solid, hollow, or at least partially hollow portion of material.

Thus, the size and shape of the extension rod/rail apertures 118 and the extension rods/rails 170 may be altered, as desired, so long as at least a portion of the extension rods/rails 170 are able to be slidably movable within the extension rod/rail apertures 118.

As illustrated most clearly in FIGS. 22-27, the buttstock assembly comprises a buttstock 160, a cheek rest 150, and two extension rods/rails 170. The buttstock 160 comprises an elongate portion of material extending from a top end 161 to a bottom end 162. A recessed channel 165 is formed in the top end of the buttstock 160. In certain exemplary embodiments, the recessed channel 165 forms a semi-circular channel. Alternatively, the recessed channel 165 may form an alternate shape, primarily as dictated by the outer shape of the buffer tube 10.

The cheek rest 150 is formed of a substantially inverted "U" or "V" shaped portion of material that extends from a first end 151 to a second end 152. The cheek rest 150 is formed so as to be permanently or releasably attached or coupled to the buttstock 160, proximate the first end 151 of the cheek rest 150 and the top end 161 of the buttstock 160.

The cheek rest 150 is formed so as to be positioned above and at least partially around the buffer tube 10 that extends from the receiver 110. It should be appreciated that the overall size and shape of the cheek rest 150 is a design choice based upon the desired appearance and/or functionality of the cheek rest 150. Generally, the cheek rest 150 is formed so as to provide a surface for a user to position his or her cheek when the buttstock 160 is positioned against the user's shoulder. Thus, it should be understood that the exterior size and shape of the cheek rest 150 may be altered to provide a desired cheek weld for a user.

In exemplary embodiments wherein the cheek rest 150 is releasably attached or coupled to the buttstock 160, alternate shapes and sizes of cheek rest 150 can be provided such that a cheek rest 150 having a desired shape can be selected by a user.

Because of the arcuate shape of the interior of the cheek rest 150, when the cheek rest 150 is attached or coupled to the buttstock 160, the space provided between the recessed channel 165 and the cheek rest 150 defines an aperture 167, which allows the buffer tube 10 to freely slide therethrough.

FIGS. 22-25 illustrate a more detailed view of the extension rods/rails 170. In various exemplary embodiments, the extension rods/rails 170 are formed of a substantially cylindrical shaped portion of material that extends from a first end 171 to a second end 172. In various exemplary embodiments, the extension rods/rails 170 comprise a solid portion of material. Alternatively, the extension rods/rails 170 comprise a hollow or tubular portion of material.

In various exemplary, nonlimiting embodiments, a rod channel 175 is formed along at least a portion of the extension rod/rail 170. In various exemplary, nonlimiting embodiments, two or more rod dimples/detents 177 are formed along the rod channel 175. Typically, a rod dimple/detent 177 is formed at each terminating end of the rod channel 175 and one or more rod dimples/detents 177 are formed along the rod channel 175. Each extension rod/rail 170 is a mirror image of the other, such that the number and position of each rod dimple/detent 177 of each extension rod/rail 170 is aligned such that each rod dimple/detent 177 of a first extension rod/rail 170 is paired with an aligned rod dimple/detent of a second extension rod/rail 170. In this manner, each rod dimple/detent 177 represents a lockable position of the buttstock 160 relative to the receiver 110.

In certain exemplary, nonlimiting embodiments, each rod dimple/detent 177 is formed of a semi-spherical recess formed in a portion of the extension rod/rail 170. Each rod dimple/detent 177 may be formed by removing, such as, for example, by machining or cutting, material from the extension rod/rail 170. Alternatively, each rod dimple/detent 177 may be formed by pressing a rod dimple/detent 177 into the extension rod/rail 170. It should be appreciated that the rod channel 175 may be formed in a manner similar to that of the rod dimples/detents 177.

By utilizing rod dimples/detents 177 and a rod channel 175, the strength and integrity of the extension rods/rails 170 is maintained and the problems introduced by cut notches in existing collapsible stocks is circumvented. Because the majority of the strength of a rod is in the outer perimeter, by utilizing circular dimples/detents that are cut or pressed into the rod, the rod is more structurally sound than a rod having a large, flat cut across the rod.

In still other embodiments, each rod dimple/detent 177 may optionally be formed of a notch or other shaped recess formed in a portion of the extension rod/rail 170.

Figure 49A:
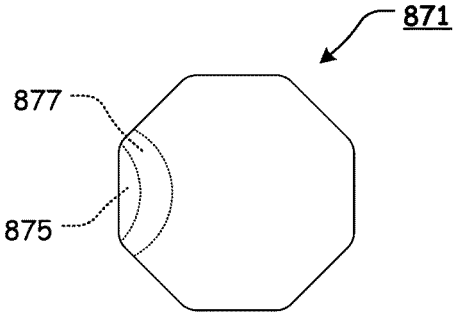
FIG. 49A illustrates a front view of an alternative exemplary embodiment of an extension rod/rail, according to this invention.
Figure 49B:
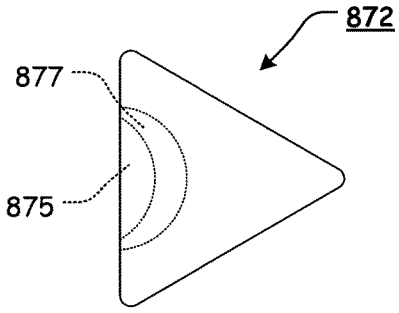
FIG. 49B illustrates a front view of an alternative exemplary embodiment of an extension rod/rail, according to this invention.
Figure 49C:
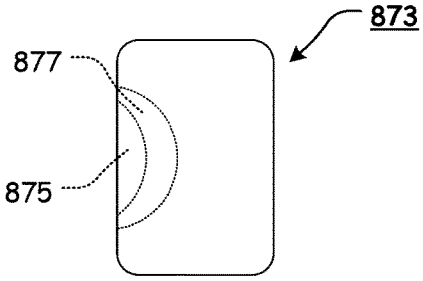
FIG. 49C illustrates a front view of an alternative exemplary embodiment of an extension rod/rail, according to this invention.
Figure 49D:
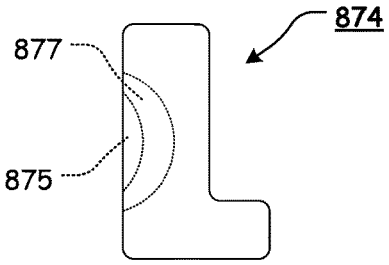
FIG. 49D illustrates a front view of an alternative exemplary embodiment of an extension rod/rail, according to this invention.
Figure 49E:
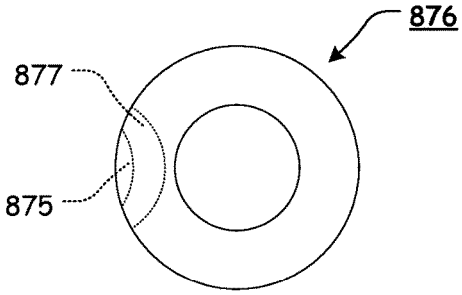
FIG. 49E illustrates a front view of an alternative exemplary embodiment of an extension rod/rail, according to this invention.
Figure 49F:
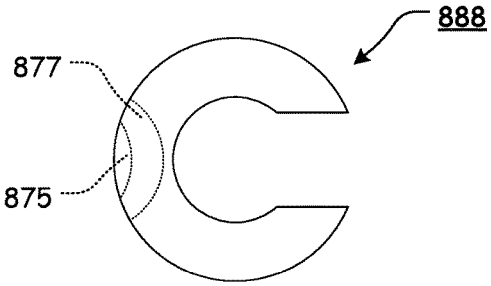
FIG. 49F illustrates a front view of an alternative exemplary embodiment of an extension rod/rail, according to this invention.

As illustrated in FIGS. 49A-49F, the extension rods/rails 170 may take on a number of profiles and still include structures that correspond to the rod channel 175 and the rod dimples/detents 177. For example, as illustrated in FIG. 49A, the extension rods/rails 871 has a substantially octagonal profile and includes a rod channel 875 and rod dimples/detents 877. As illustrated in FIG. 49B, the extension rods/rails 872 has a substantially triangular profile and includes a rod channel 875 and rod dimples/detents 877; as illustrated in FIG. 49C, the extension rods/rails 873 has a substantially rectangular profile and includes a rod channel 875 and rod dimples/detents 877; as illustrated in FIG. 49D, the extension rods/rails 874 has a substantially "L" shaped profile and includes a rod channel 875 and rod dimples/detents 877; as illustrated in FIG. 49E, the extension rods/rails 876 has a substantially circular, hollow profile and includes a rod channel 875 and rod dimples/detents 877; and as illustrated in FIG. 49F, the extension rods/rails 888 has a substantially C-shaped profile and includes a rod channel 875 and rod dimples/detents 877.

By utilizing one or more latch elements 140, a smooth, ball bearing-type action is provided to the lock mechanism. This system provides reduced contact surface friction and smoother and easier manipulation of the components, particularly when compared to a square/rectangular notch.

As illustrated, a first extension rod/rail 170 and a second extension rod/rail 170 are attached or coupled to the buttstock 160 so as to extend from the buttstock 160. The extension rods/rails 170 extend from the buttstock 160 so as to be aligned with and slidable within the extension rod/rail apertures 118 of the integral stock connector component 115.

As illustrated most clearly in FIGS. 17-21, the latch assembly comprises a latch cover 120, a latch 130, at least one latch element 140, and one or more latch biasing elements 145. The latch cover 120 is formed so as to be attached or coupled to the integral stock connector component 115. In various exemplary, nonlimiting embodiments, the latch cover 120 is attached or coupled to the integral stock connector component 115 via one or more screws 190. Alternatively, depending upon the materials used to create the receiver 110 and the latch cover 120, the latch cover 120 may be adhesively or otherwise permanently or removably attached to the integral stock connector component 115.

In still other exemplary, nonlimiting embodiments, the latch cover 120 may be formed as an integral component of the receiver 110.

The latch cover 120 includes interior side walls defining a latch cover cavity 122 formed so as to receive at least a portion of the latch 130 therein. The latch cover cavity 122 includes not only space for at least a portion of the latch 130, but also rod/rail apertures 124 formed therethrough. The rod/rail apertures 124 are formed so as to be aligned with the extension rod/rail apertures 118 and to slidably receive the extension rods/rails 170 that extend from the buttstock 160. In this manner, when the latch cover 120 is attached or coupled to the integral stock connector component 115, the extension rods/rails 170 are repeatably, slidably movable within the aligned rod/rail apertures 124 and the extension rod/rail apertures 118.

The latch 130 extends from an engagement portion 132 to a protrusion portion 136. An extension shoulder 134 is disposed between the engagement portion 132 and the protrusion portion 136. At least a portion of the extension shoulder 134 extends laterally, away from the longitudinal axis $A_{LL}$ of the latch 130, beyond a width of the engagement portion 132. At least a portion of the protrusion portion 136 extends laterally, away from the longitudinal axis $A_{LL}$ of the latch 130, beyond a width of the extension shoulder 134.

Figure 20:
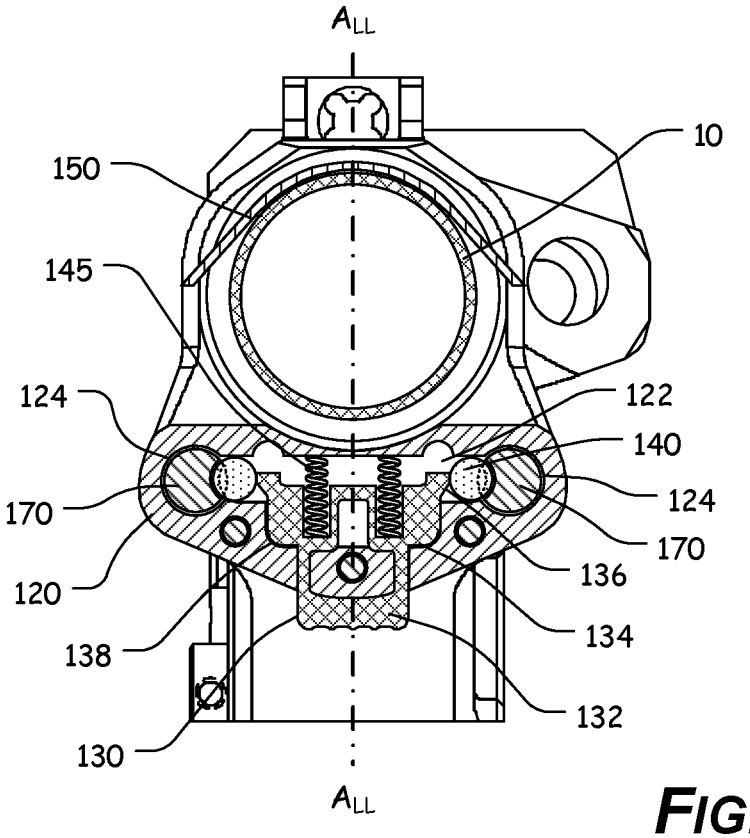
FIG. 20 illustrates a cross-sectional view taken along line 20-20 of the receiver and collapsible buttstock of FIG. 9, wherein the latch is in an engaged, or locked position, according to this invention.
Figure 21:
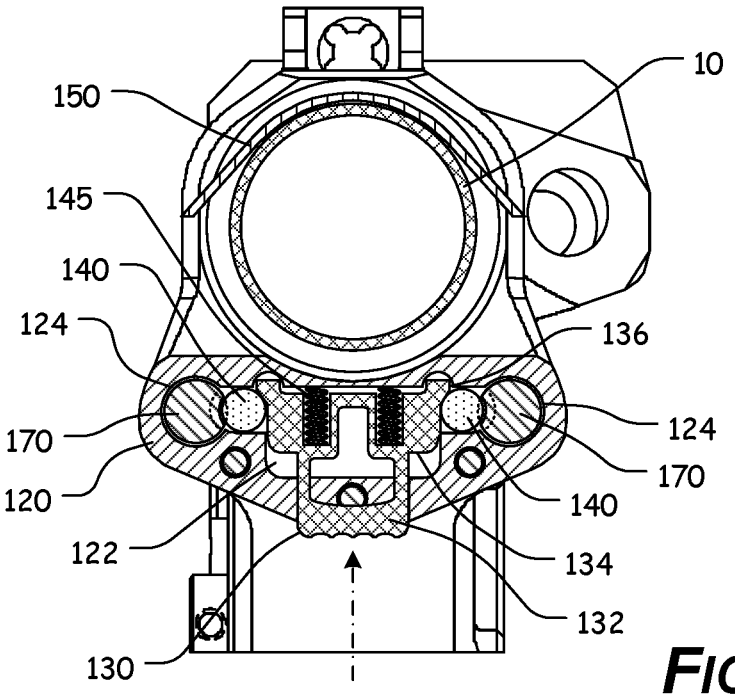
FIG. 21 illustrates the cross-sectional view taken along line 20-20 of the receiver and collapsible buttstock of FIG. 9, wherein the latch is in a disengaged or unlocked position, according to this invention.
Figure 22:
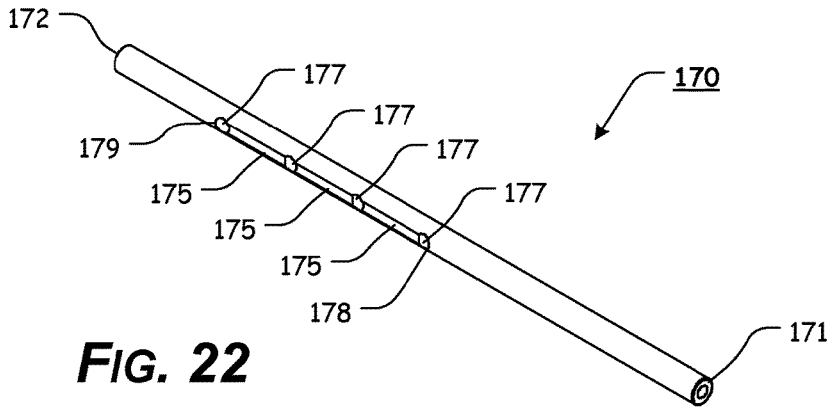
FIG. 22 illustrates a lower, rear perspective view of a first exemplary embodiment of an extension rod/rail, according to this invention.
Figure 23:
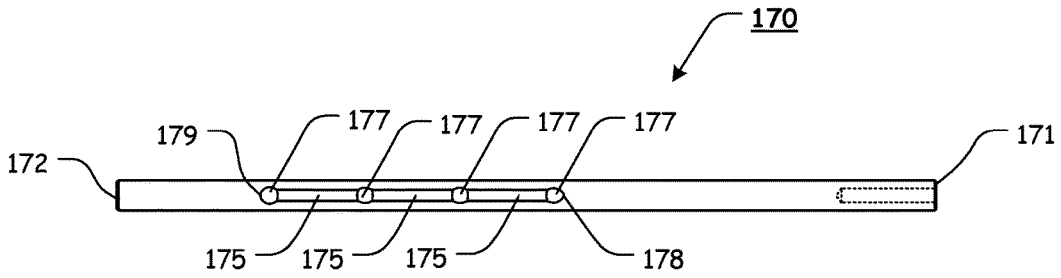
FIG. 23 illustrates a side view of a first exemplary embodiment of an extension rod/rail, according to this invention.
Figure 24:
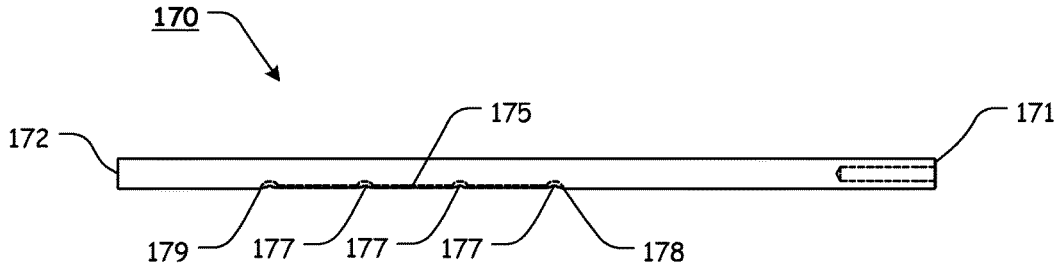
FIG. 24 illustrates a top view of a first exemplary embodiment of an extension rod/rail, according to this invention.
Figure 25:
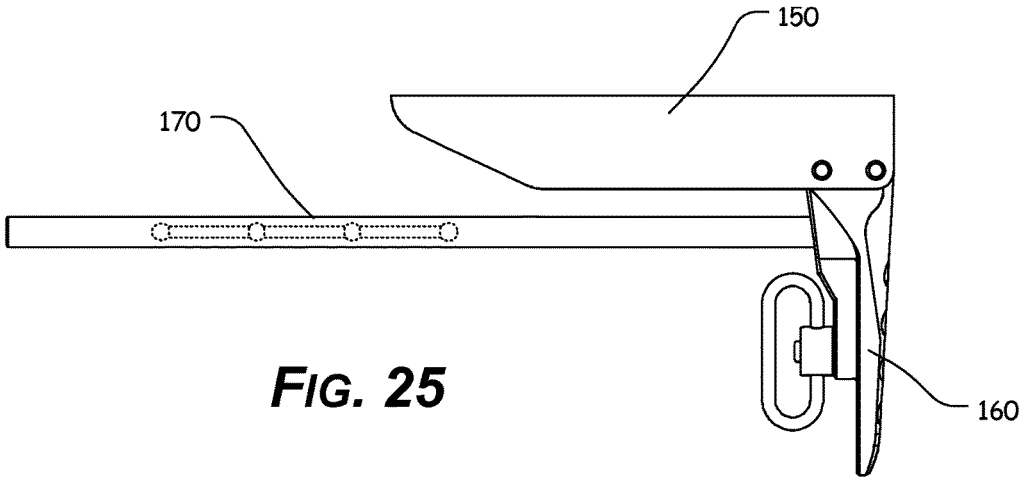
FIG. 25 illustrates a left side view of a first exemplary embodiment of a buttstock assembly, according to this invention.
Figure 26:
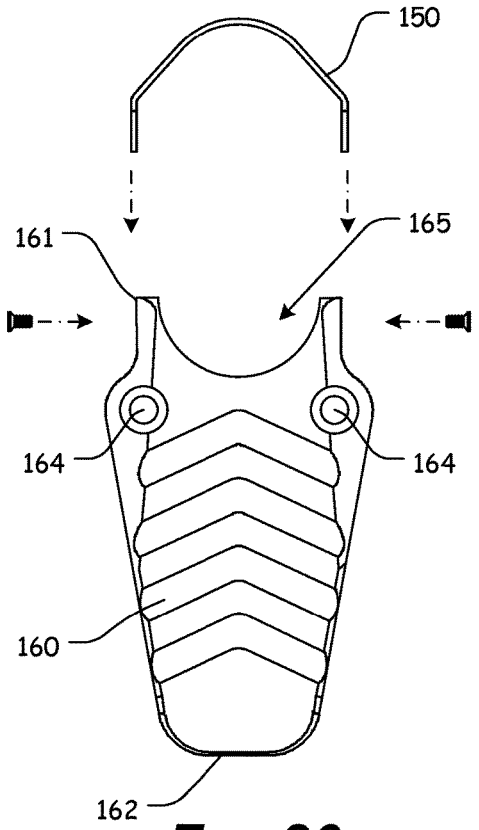
FIG. 26 illustrates a rear, exploded view of a first exemplary embodiment of a cheek rest and buttstock, according to this invention.
Figure 27:
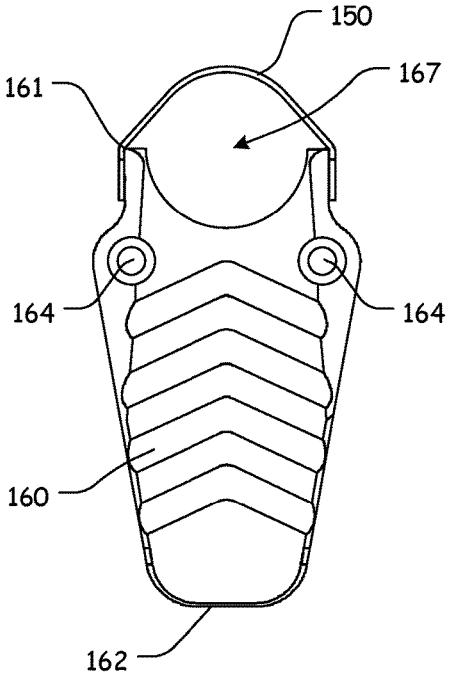
FIG. 27 illustrates a rear view of a first exemplary embodiment of an assembled cheek rest and buttstock, according to this invention.

When the latch 130 is positioned within the latch cover cavity 122, the extension shoulder 134 interacts with side walls of the latch cover cavity 122 to maintain the latch 130 within the latch cover cavity 122. Thus, while maintained within the latch cover cavity 122, at least a portion of the engagement portion 132 protrudes from the latch cover 120 and the latch 130 is movable, along its longitudinal axis $A_{LL}$. Between an engaged, or locked position, as illustrated in FIG. 20, and a disengaged or unlocked position, as illustrated in FIG. 21.

In various exemplary embodiments, a latch element 140 is positioned proximate either side of the latch cover cavity 122 and maintained between the rod/rail apertures 124 and the protrusion portions 136. In various exemplary, nonlimiting embodiments, each latch element 140 comprises a spherical ball. Alternatively, each of said latch elements 140 may comprise a cylindrical or other portion of material.

When the latch 130 is in the disengaged or unlocked position, the protrusion portions 136 are urged so as to allow the latch elements 140 to retract further into the latch cover cavity. When the latch 130 is in the engaged or locked position, the protrusion portions 136 urge the latch elements 140 into the rod/rail apertures 124.

While the latch assembly is illustrated and described as including latch element(s) 140, it should be appreciated that the latch element(s) 140 may be replaced by one or more protrusion portions, rectangular latches, or the like. Thus, it should be understood that any device, element, or feature able to be at least partially positioned within a rod channel 175 and/or rod dimples/detent 177 may be used as or in place of a latch element 140.

Additionally, while the receiver and collapsible buttstock 100 is illustrated as including two latch elements 140, it should be appreciated that the locking mechanism of the receiver and collapsible buttstock 100 may only utilize a single latch element 140, positioned proximate a single side of the latch cover cavity 122 and maintained between a single rod/rail aperture 124 and protrusion portion 136.

Figure 44:
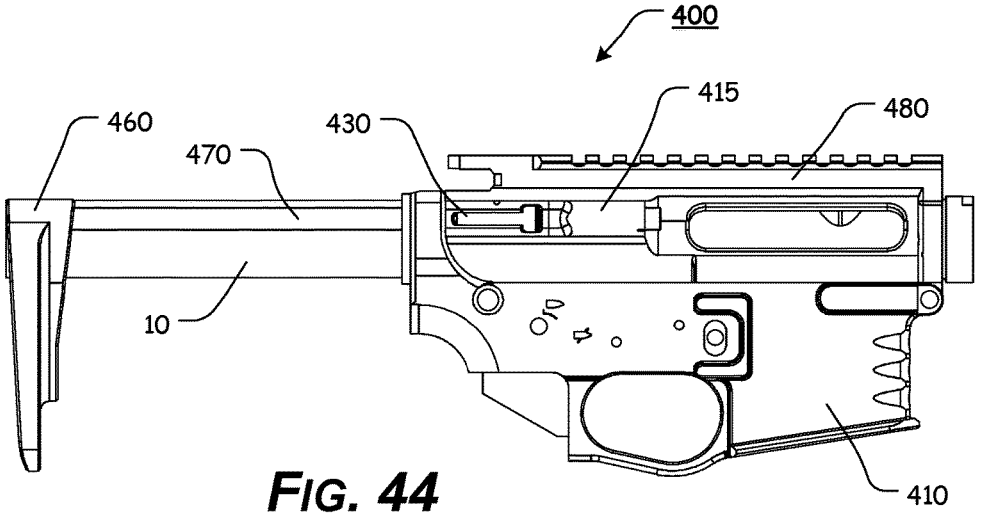
FIG. 44 illustrates a right side view of an exemplary embodiment of an upper receiver and collapsible buttstock being assembled together with a lower receiver and buffer tube, according to this invention.
Figure 45:
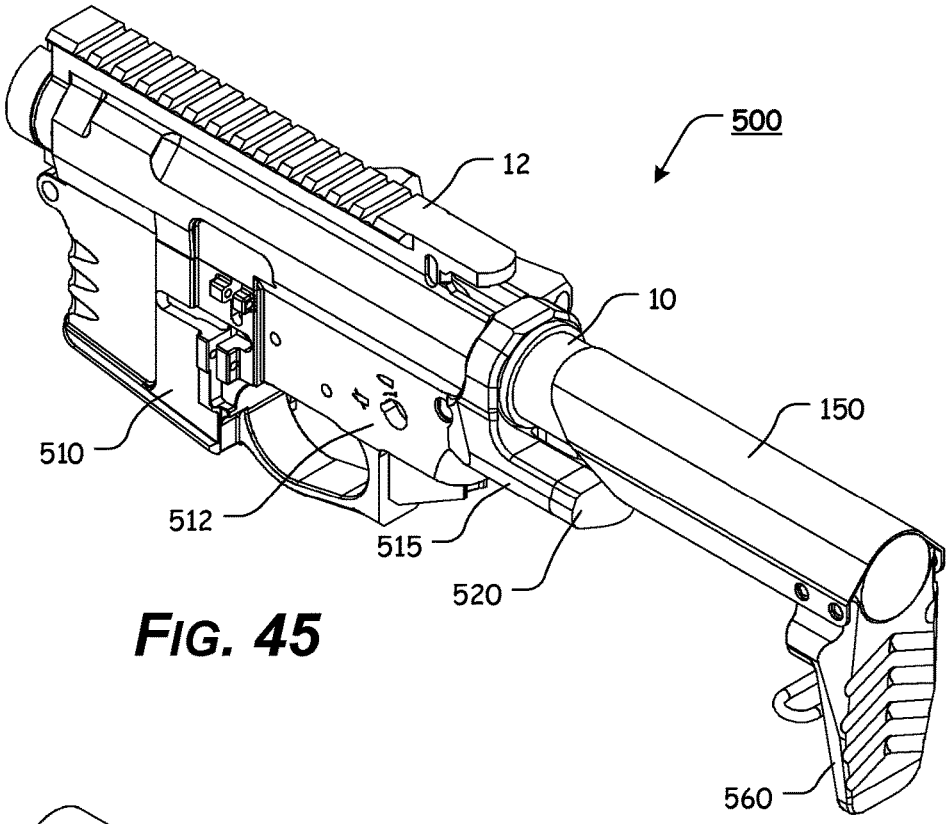
FIG. 45 illustrates an upper, left, rear perspective view of an alternate exemplary embodiment of a receiver and collapsible buttstock being assembled together with an upper receiver and buffer tube, according to this invention.
Figure 46:
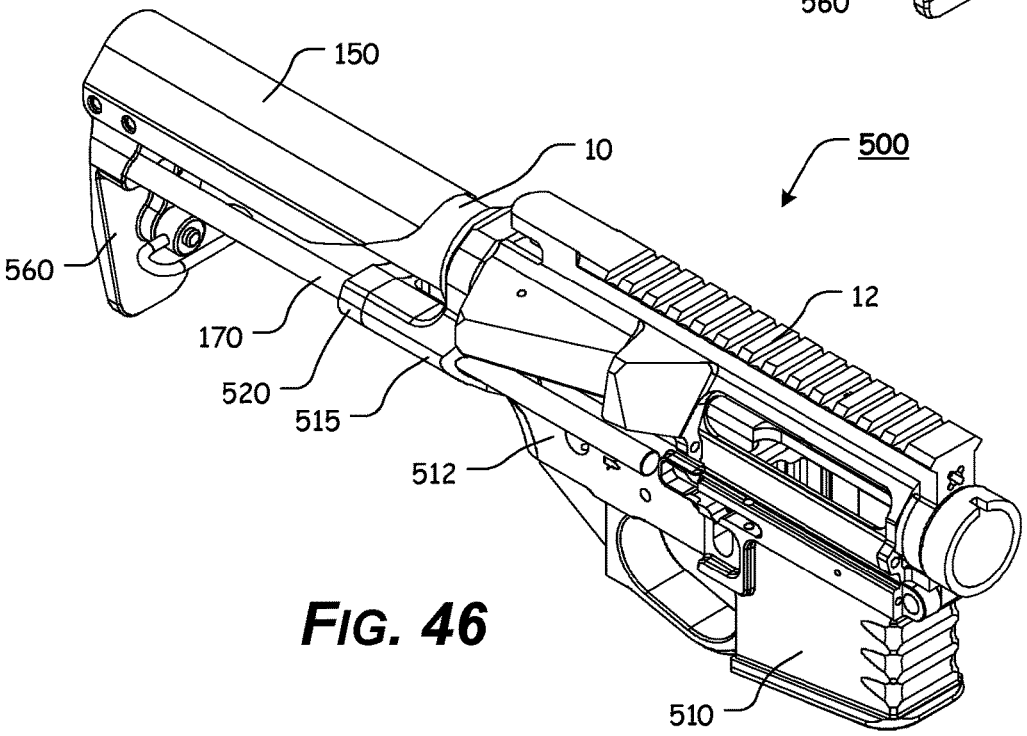
FIG. 46 illustrates an upper, right, front perspective view of an alternate exemplary embodiment of a receiver and collapsible buttstock being assembled together with an upper receiver and buffer tube, according to this invention.

For example, FIGS. 44-45 illustrate an exemplary receiver and collapsible buttstock 500, which includes a receiver 510 having exterior side walls 512 and a modified integral stock connector component 515 and a modified latch cover 520. The integral stock connector component 515 and the modified latch cover 520 each include only a single rod/rail aperture. Additionally, only a single extension rod/rail 170 extends from the buttstock 560.

One or more biasing element receiving recesses 138 may optionally be formed within an upper portion of the latch 130. The biasing element receiving recess(es) 138 allow one or more latch biasing elements 145 to be at least partially positioned therein so as to maintain alignment of the latch biasing elements 145 between the latch 130 and the interior of the latch cover cavity 122.

In various exemplary embodiments, the biasing elements 145 comprise a spring. Alternatively, the biasing element(s) 145 may comprise a single spring or multiple springs, a leaf spring, a resilient portion of material, such as, for example, rubber or silicone, or any other mechanism that can store and return energy in a fashion similar to that of a spring.

Figure 47:
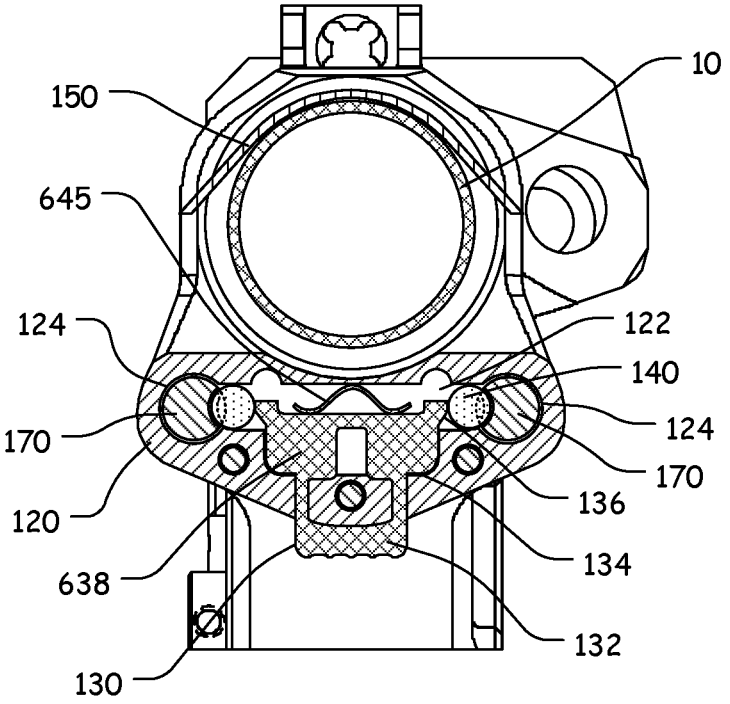
FIG. 47 illustrates a cross-sectional view taken along line 20-20 of the receiver and collapsible buttstock of FIG. 9, illustrating alternate embodiments of a spring biasing element, according to this invention.
Figure 48:
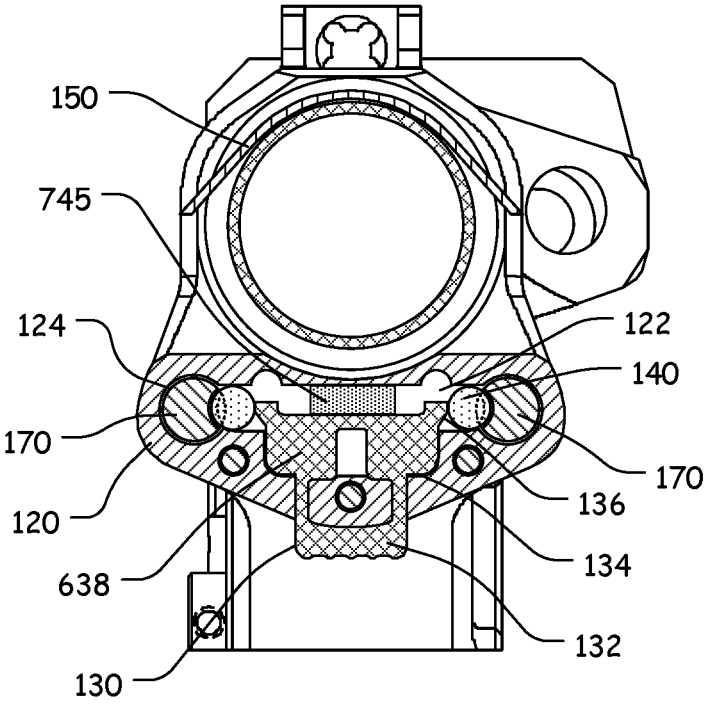
FIG. 48 illustrates the cross-sectional view taken along line 20-20 of the receiver and collapsible buttstock of FIG. 9, illustrating yet another alternate embodiment of a spring biasing element, according to this invention.

In still other exemplary embodiments, as illustrated in FIGS. 47 and 48, the spring biasing element(s) 145 may optionally be replaced with a spring biasing element 645, such as, for example, a bent piece of spring steel or leaf spring. Alternatively, the spring biasing element(s) 145 may optionally be replaced with a spring biasing element 745, such as, for example, a resilient block or portion of material.

In certain of these exemplary embodiments, as illustrated, the one or more biasing element receiving recesses 138 are removed from the latch 130.

The biasing elements 145 are positioned between the latch 130 and an interior surface of the latch cover cavity 122, so as to bias the latch 130 to the engaged or locked position, as illustrated in FIG. 20.

The interaction between the latch elements 140 and the rod/rail apertures 124 is such that when the latch 130 is in the disengaged or unlocked position, the latch elements 140 are retracted so as to travel within the rod channels 175 of the extension rods/rails 170. However, while in the disengaged or unlocked position, the latch 130 limits the retraction of the latch elements 140 within the latch cover cavity 122 such that the latch elements 140 protrude into the rod/rail apertures 124 a sufficient distance to be maintained within the rod channel 175, thereby limiting the slidable movement of the extension rods/rails 170 (and the cheek rest 150 and buttstock 160) relative to the receiver 110.

In the engaged or locked position, the latch 130 urges the latch elements 140 further into the rod/rail apertures 124, thereby maintaining each latch element 140 within a rod dimple/detent 177.

Thus, through interaction of the latch elements 140 and the rod dimples/detents 177, the buttstock assembly can be releasably secured at a desired position relative to the receiver 110.

In various exemplary embodiments, various components of the receiver and collapsible buttstock 100 are substantially rigid and are formed of aluminum. Alternate materials of construction of the various components of the receiver and collapsible buttstock 100 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the receiver and collapsible buttstock 100 is a design choice based on the desired appearance and functionality of the receiver and collapsible buttstock 100.

It should be appreciated that certain elements of the receiver and collapsible buttstock 100 may be formed as an integral unit (such as, for example, the buttstock 160 and the extension rods/rails 170). Alternatively, suitable materials can be used and sections or elements made independently and attached or coupled together, such as by adhesives, welding, screws, rivets, pins, or other fasteners, to form the various elements of the receiver and collapsible buttstock 100.

It should also be understood that the overall size and shape of the receiver and collapsible buttstock 100, and the various portions thereof, is a design choice based upon the desired functionality and/or appearance of the receiver and collapsible buttstock 100.

Figure 9:
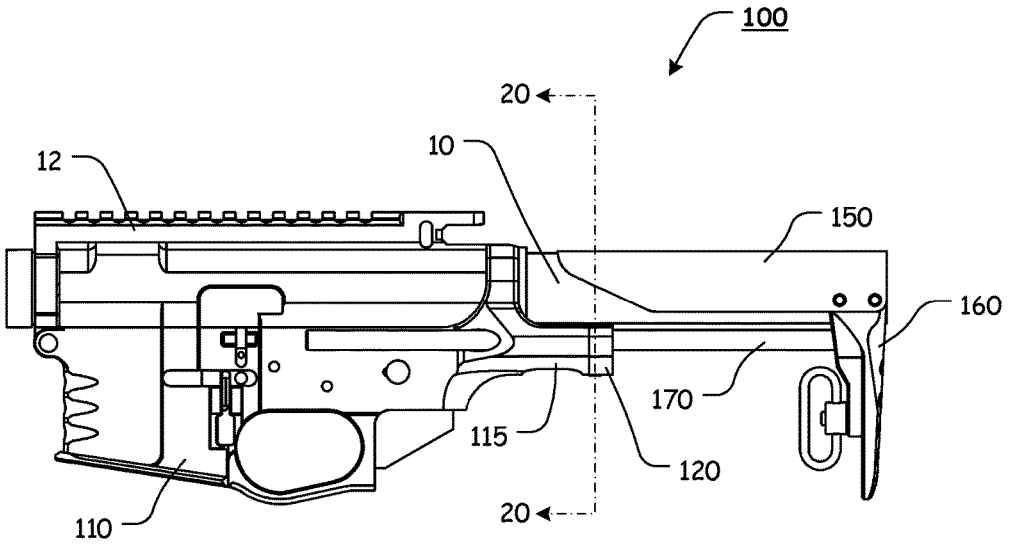
FIG. 9 illustrates a left side view of a first exemplary embodiment of a receiver and collapsible buttstock being assembled together with an upper receiver and buffer tube, wherein the buttstock assembly is in a fully collapsed position, according to this invention.
Figure 10:
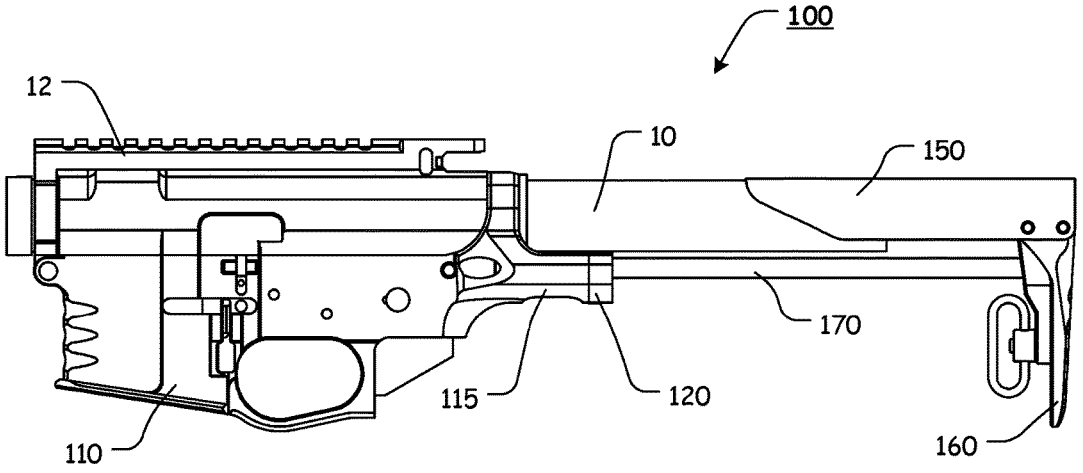
FIG. 10 illustrates a left side view of a first exemplary embodiment of a receiver and collapsible buttstock being assembled together with an upper receiver and buffer tube, wherein the buttstock assembly is in a fully extended position, according to this invention.
Figure 11:
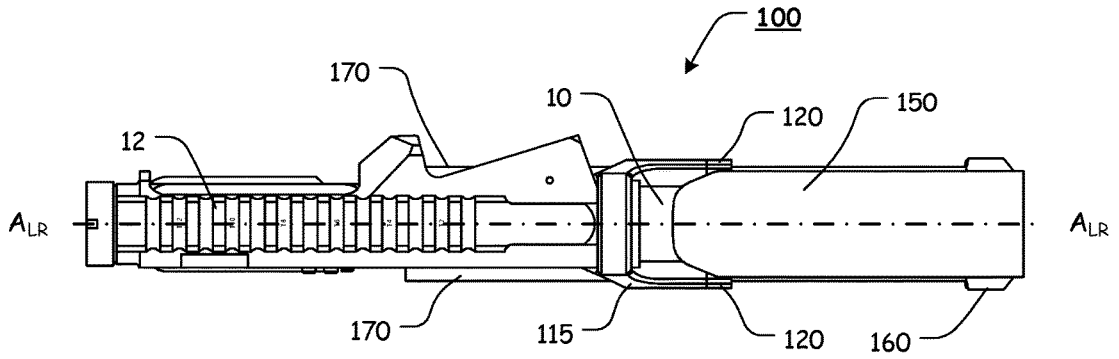
FIG. 11 illustrates a top view of a first exemplary embodiment of a receiver and collapsible buttstock being assembled together with an upper receiver and buffer tube, wherein the buttstock assembly is in a fully collapsed position, according to this invention.
Figure 12:
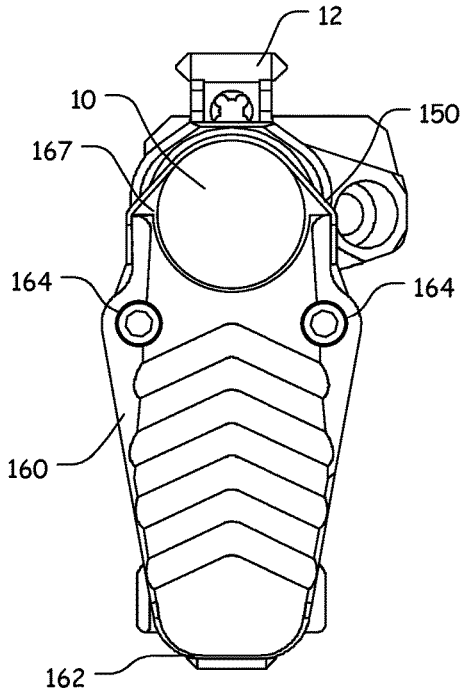
FIG. 12 illustrates a rear view of a first exemplary embodiment of a receiver and collapsible buttstock being assembled together with an upper receiver and buffer tube, according to this invention.
Figure 13:
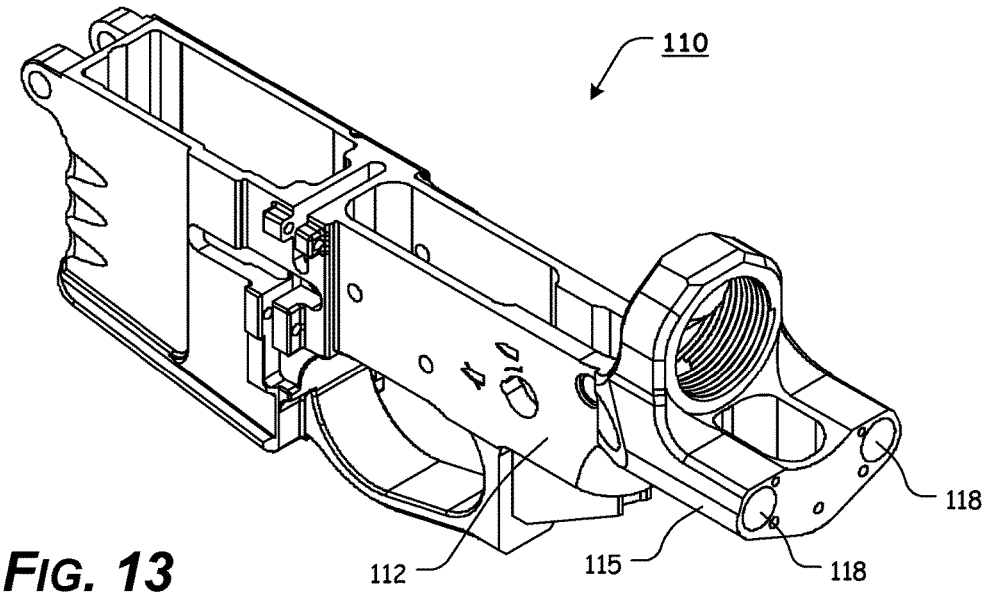
FIG. 13 illustrates an upper, left, rear perspective view of a first exemplary embodiment of a receiver, according to this invention.
Figure 14:
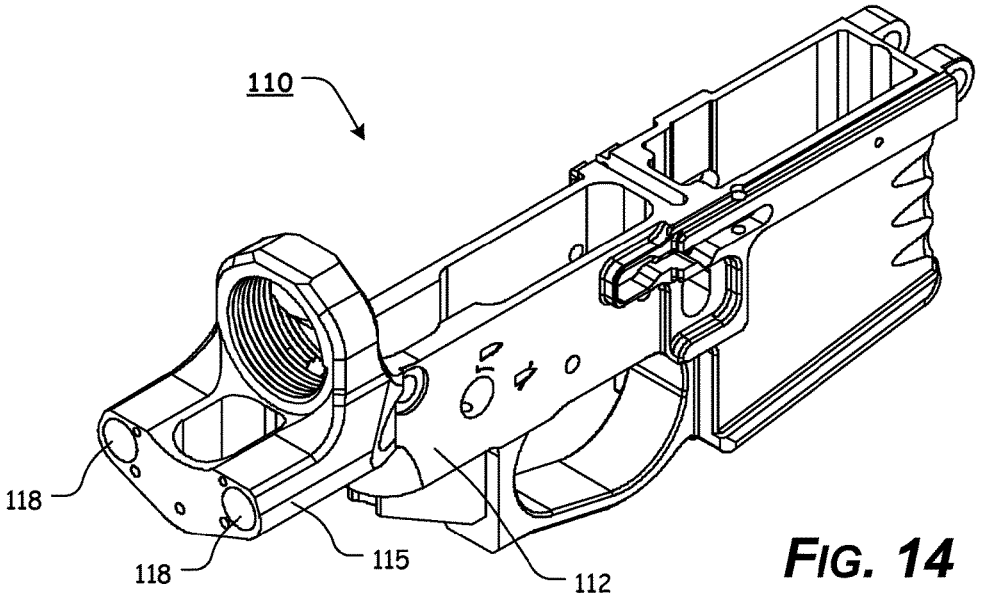
FIG. 14 illustrates an upper, right, rear perspective view of a first exemplary embodiment of a receiver, according to this invention.
Figure 15:
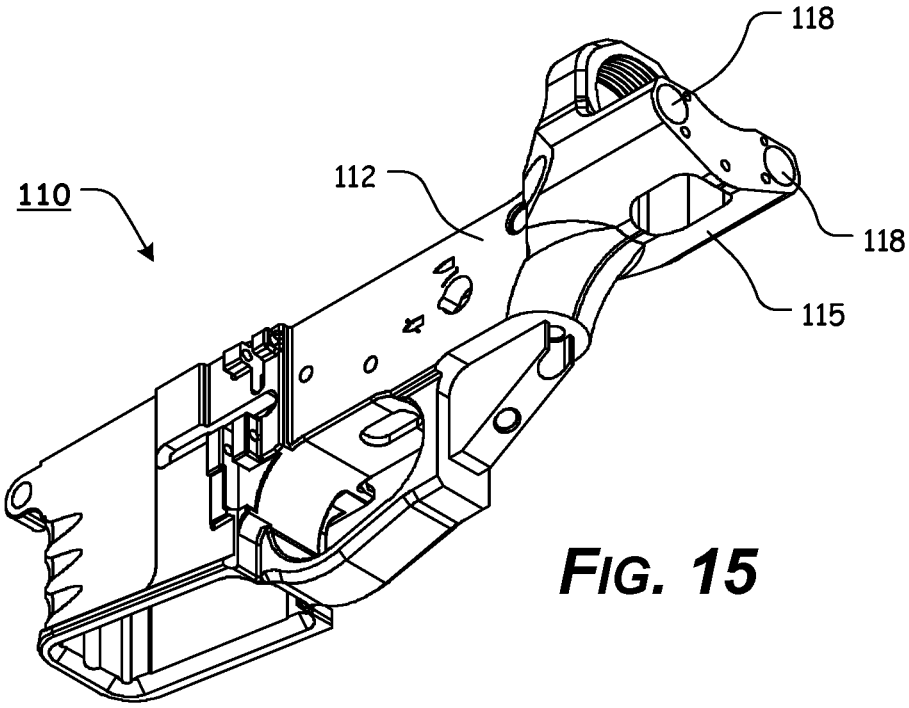
FIG. 15 illustrates a lower, left, rear perspective view of a first exemplary embodiment of a receiver, according to this invention.
Figure 16:
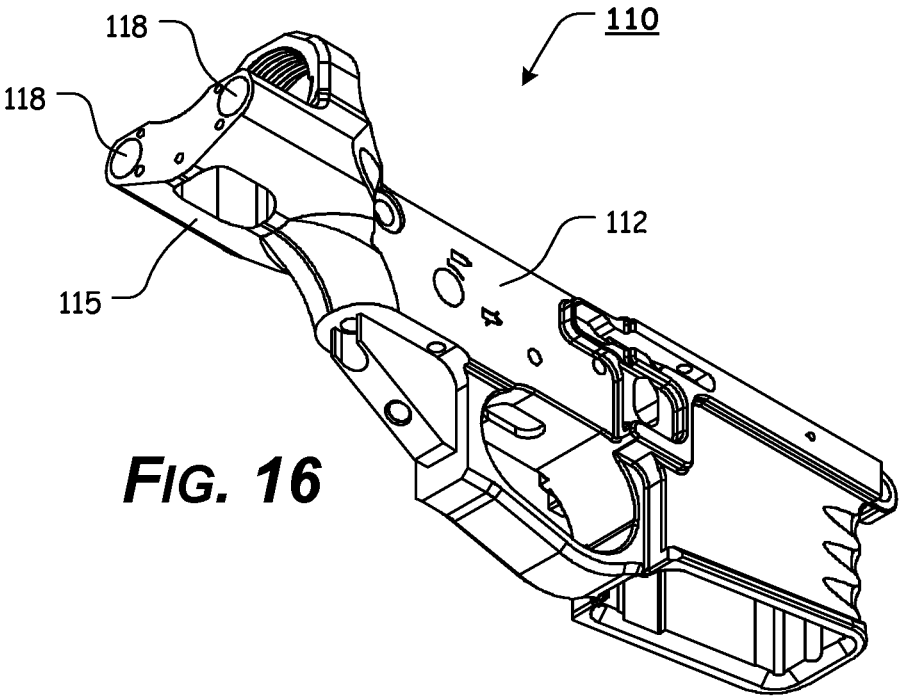
FIG. 16 illustrates a lower, right, rear perspective view of a first exemplary embodiment of a receiver, according to this invention.
Figure 17:
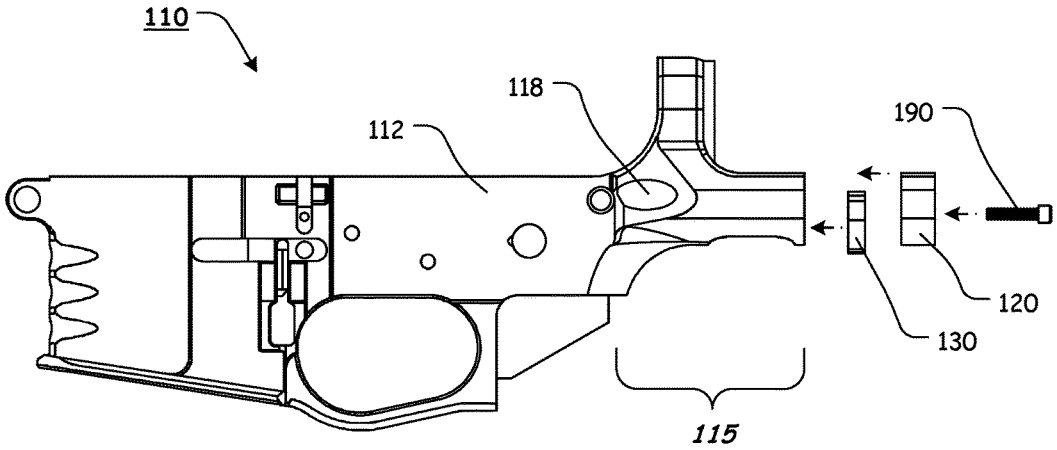
FIG. 17 illustrates an left side, exploded view of a first exemplary embodiment of a receiver, latch, latch cover, and attachment screw, according to this invention.
Figure 18:
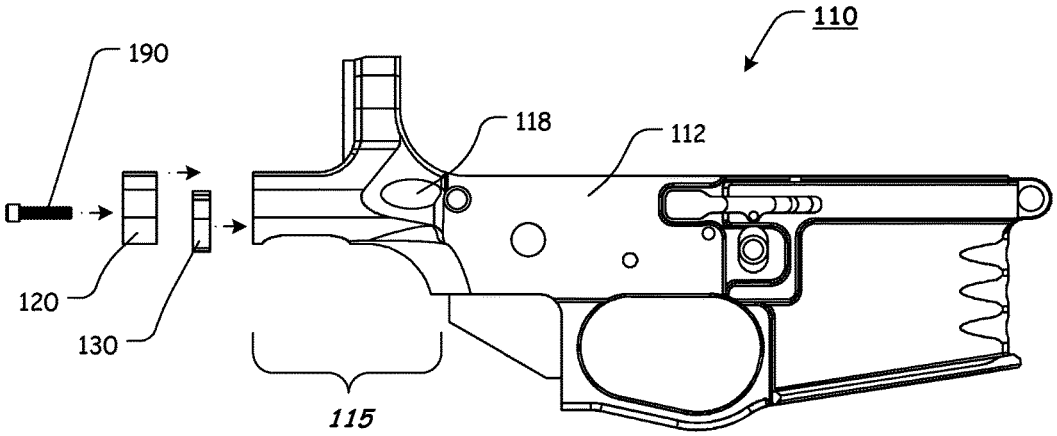
FIG. 18 illustrates an right side, exploded view of a first exemplary embodiment of a receiver, latch, latch cover, and attachment screw, according to this invention.

During use, the buttstock assembly may initially be presented in a retracted or collapsed position, as illustrated in FIG. 9. In this position, the latch 130 is in the engaged or locked position and the latch elements 140 are positioned within the rod dimples/detents 177 formed at a first terminal end 178 of the rod channel 175. The interaction of the protrusion portions 136, the latch elements 140, and the rod dimples/detents 177 is sufficient to maintain the buttstock assembly in the collapsed or retracted position even if a withdrawing force is applied to the buttstock assembly.

When a user desires to extend the buttstock assembly, the user merely urges the latch 130 upward, along the longitudinal axis ALL, to the disengaged or unlocked position. Because of the convenient position of the engagement portion 132 of the latch 130, intentional manipulation of the latch 130 can be accomplished easily, with the user's finger, thumb, or another surface.

As the latch 130 is urged toward the disengaged or unlocked position, the protrusion portions 136 allow the latch elements 140 to retract into the latch cover cavity 122 a sufficient distance so as to be removed from the rod dimples/detents 177 but maintained within the rod channel 175. Thus, the extension rods/rails 170 can be slidably withdrawn from the rod/rail apertures 124 and the extension rail apertures 118, a distance permitted by the length of the rod channel 175 and the rod dimple/detent positioned at the second terminal end 179 of the rod channel 175.

In certain exemplary, nonlimiting embodiments, the distance from the first terminal end 178 of the rod channel 175 to the second terminal end 179 of the rod channel 175 is approximately 3 inches. Alternatively, the distance from the terminal ends may be greater or less than 3 inches and may be, for example, 2-10 inches or more.

When the user no longer urges the latch 130 to the unlocked or disengaged position, the spring bias of the latch biasing elements 145 urges the latch 130 toward the engaged or locked position, such that the latch elements 140 may continue to allow slidable movement of the extension rods/rails 170 until the latch elements 140 reach a rod dimple/detent 177. Upon reaching a rod dimple/detent 177, the spring biasing force of the latch biasing elements 145 urges the latch elements 140 into the rod dimples/detents 177, thereby locking the buttstock assembly into a given position relative to the receiver 110.

Figure 28:
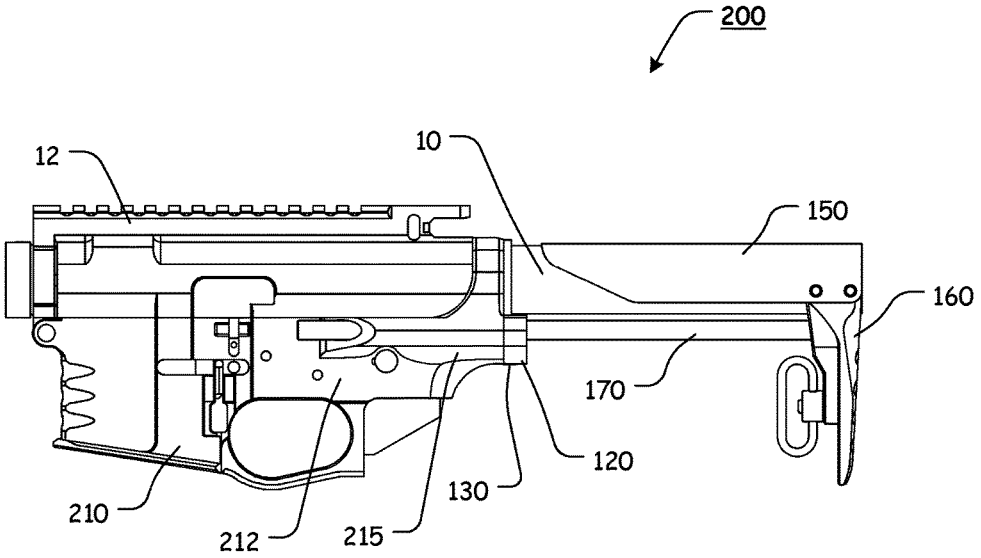
FIG. 28 illustrates a left side view of a second exemplary embodiment of a receiver and collapsible buttstock being assembled together with an upper receiver and buffer tube, wherein the buttstock assembly is in a fully collapsed position, according to this invention.
Figure 29:
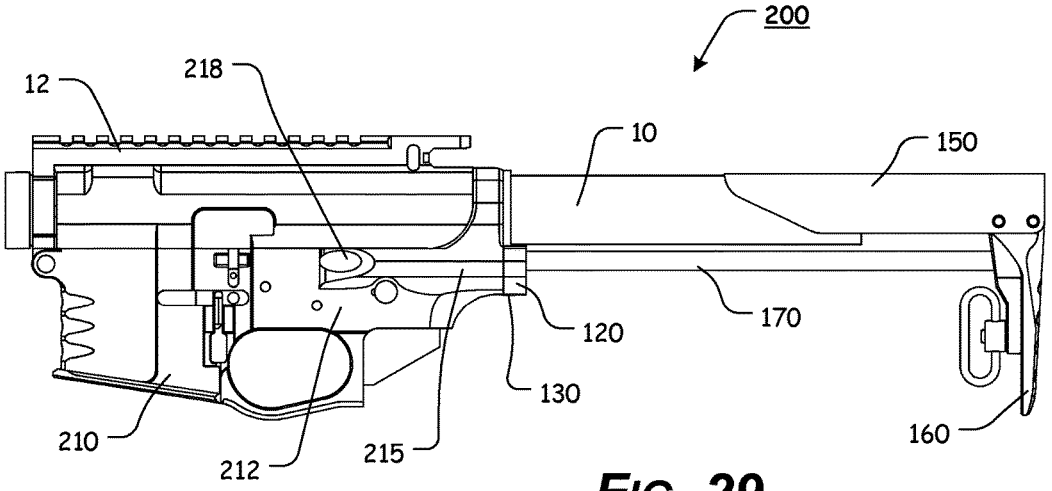
FIG. 29 illustrates a left side view of a second exemplary embodiment of a receiver and collapsible buttstock being assembled together with an upper receiver and buffer tube, wherein the buttstock assembly is in a fully extended position, according to this invention.

FIGS. 28-29 illustrate a second exemplary embodiment of a receiver and collapsible buttstock 200 being assembled together with an upper receiver 12 and buffer tube 10. FIG. 28 illustrates the buttstock assembly in a fully collapsed position, while FIG. 29 illustrates the buttstock assembly in a fully extended position.

As shown in FIGS. 28-29, the receiver and collapsible buttstock 200 comprises elements similar to those of the receiver and collapsible buttstock 100. However, as shown in FIGS. 28-29, the receiver 100 is replaced by the receiver 210. Receiver 210 includes an integral stock connector component 215 that extends rearward, as far as the buffer tube attachment aperture of the receiver 210. Thus, the integral stock connector component 215 does not extend as far rearward as the integral stock connector component 115.

Additionally, the integral stock connector component 215 extends along a greater portion of the receiver 210 (and the exterior wall surfaces 212 of the receiver 210) than the integral stock connector component 115 extends along the receiver 110.

Figure 30:
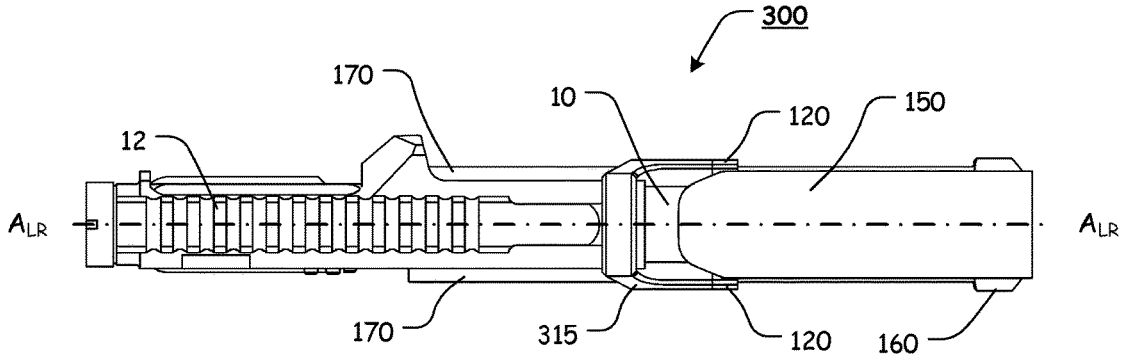
FIG. 30 illustrates a top view of a third exemplary embodiment of a receiver and collapsible buttstock being assembled together with an upper receiver and buffer tube, wherein the buttstock assembly is in a fully collapsed position, according to this invention.
Figure 31:
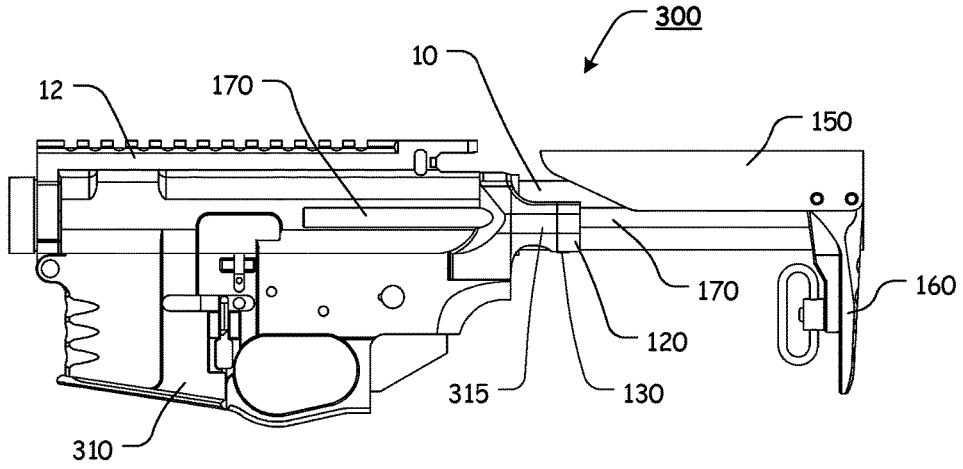
FIG. 31 illustrates a left side view of a third exemplary embodiment of a receiver and collapsible buttstock being assembled together with an upper receiver and buffer tube, wherein the buttstock assembly is in a fully collapsed position, according to this invention.
Figure 32:
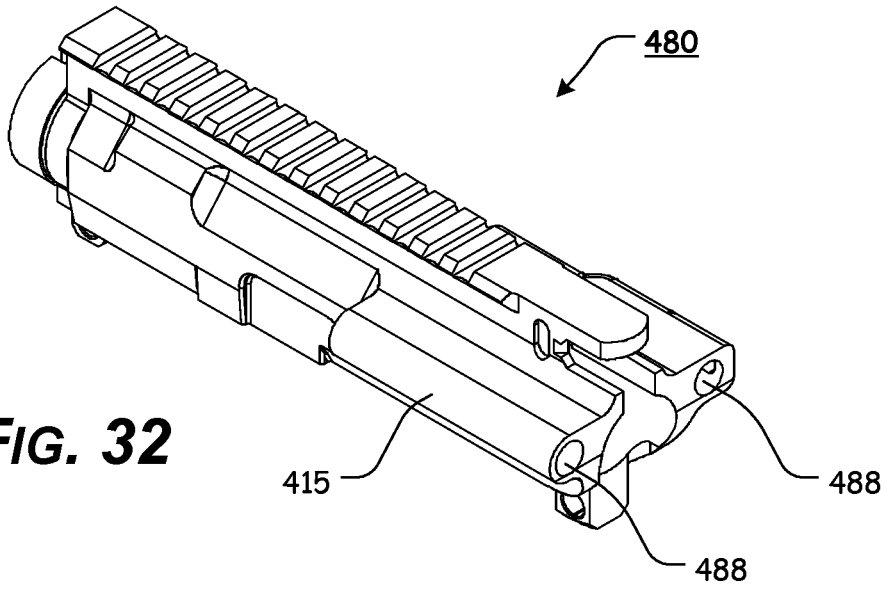
FIG. 32 illustrates an upper, left, rear perspective view of an exemplary embodiment of an upper receiver, according to this invention.
Figure 33:
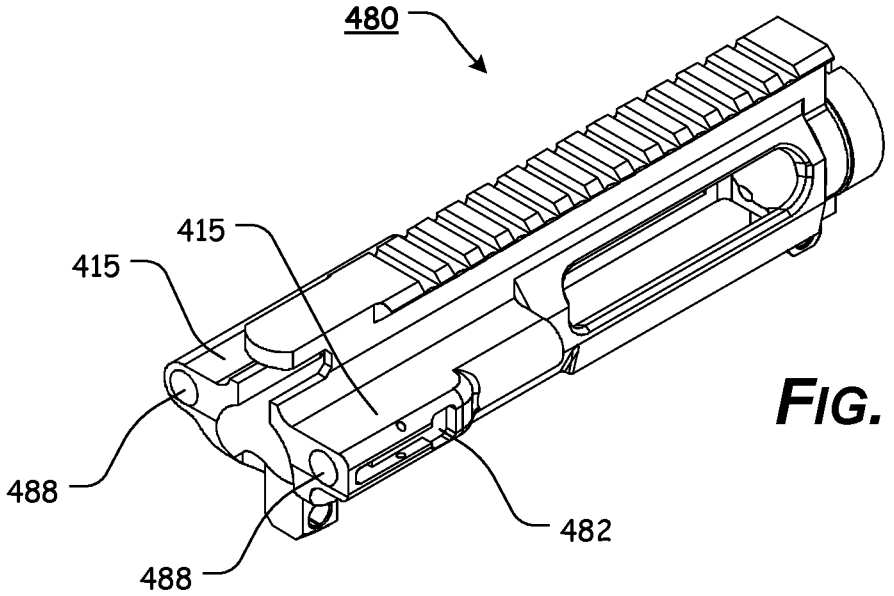
FIG. 33 illustrates an upper, right, rear perspective view of an exemplary embodiment of an upper receiver, according to this invention.
Figure 34:
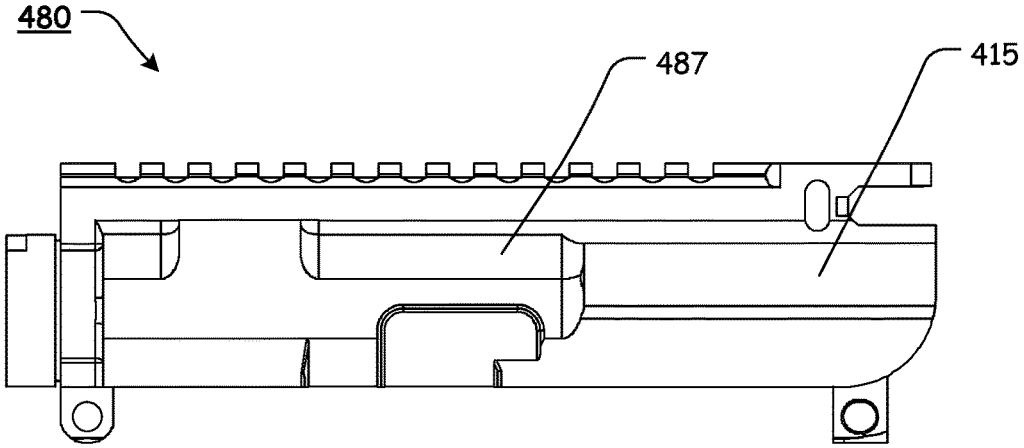
FIG. 34 illustrates a left, side view of an exemplary embodiment of an upper receiver, according to this invention.
Figure 35:
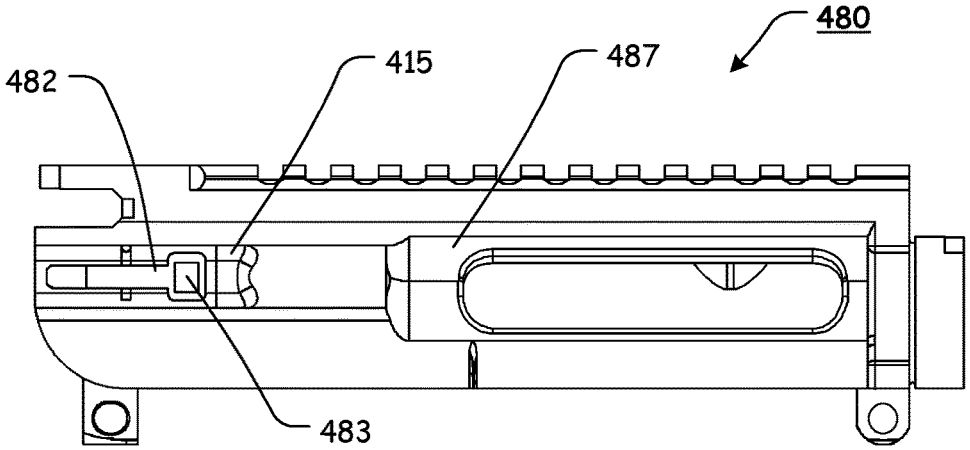
FIG. 35 illustrates a right, side view of an exemplary embodiment of an upper receiver, according to this invention.
Figure 36:
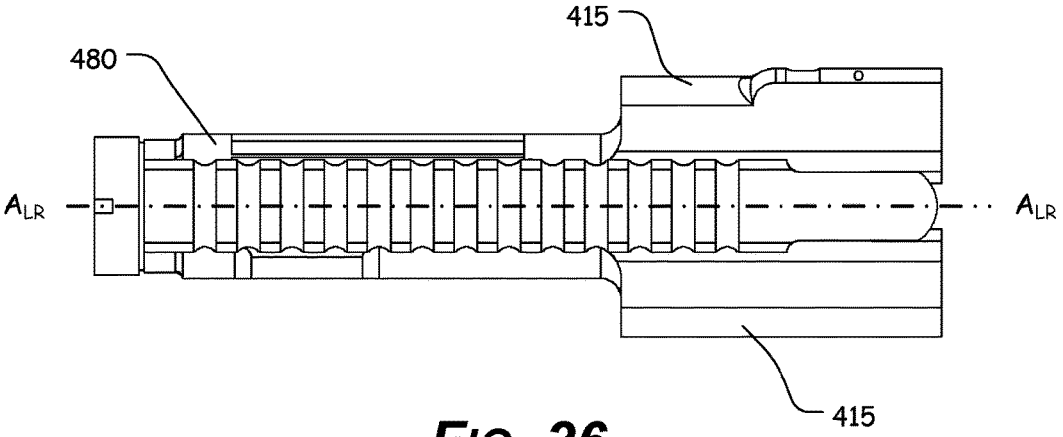
FIG. 36 illustrates a top view of an exemplary embodiment of an upper receiver, according to this invention.
Figure 37:
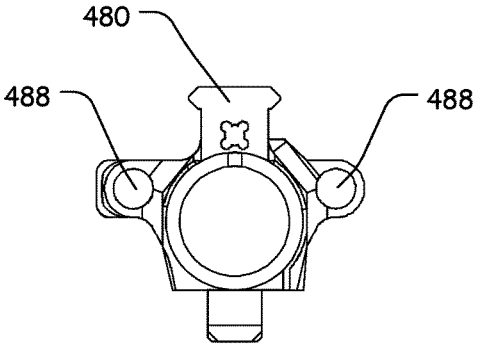
FIG. 37 illustrates a front view of an exemplary embodiment of an upper receiver, according to this invention.
Figure 38:
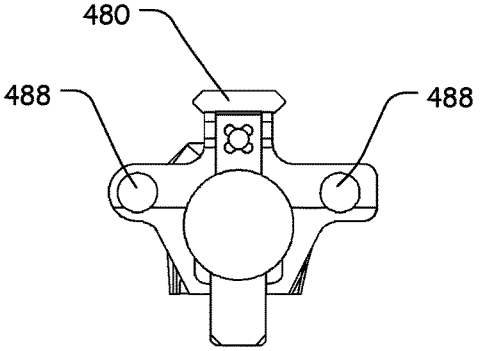
FIG. 38 illustrates a rear view of an exemplary embodiment of an upper receiver, according to this invention.
Figure 39:
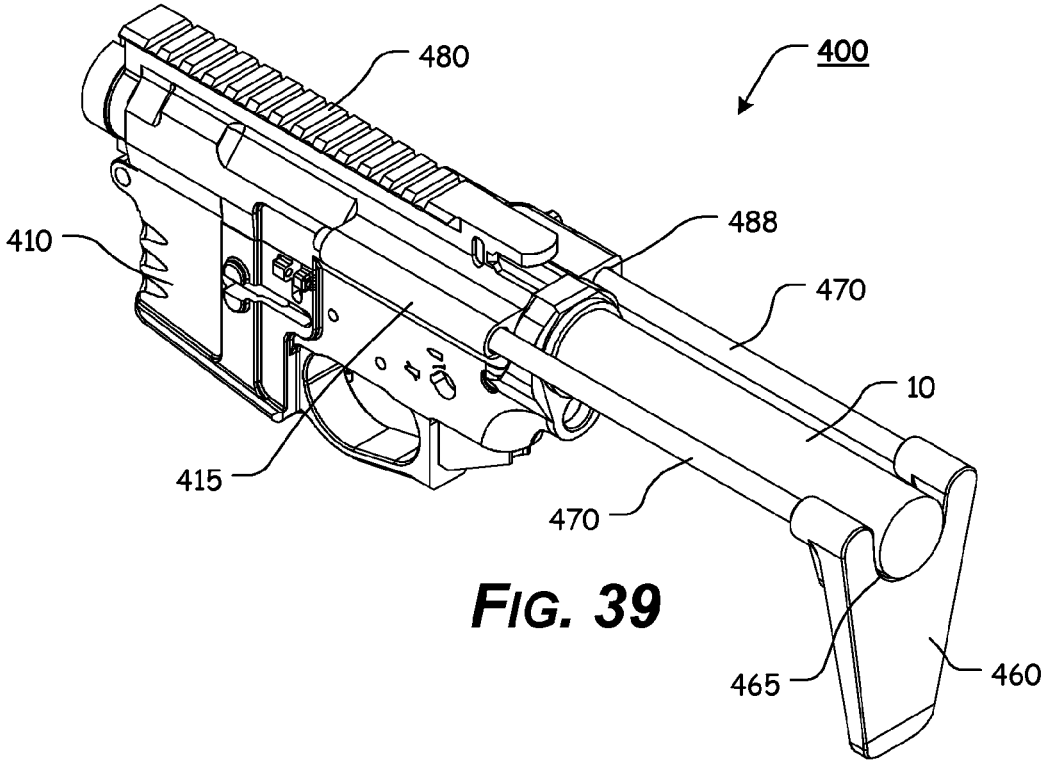
FIG. 39 illustrates an upper, left, rear perspective view of an exemplary embodiment of an upper receiver and collapsible buttstock being assembled together with a lower receiver and buffer tube, according to this invention.
Figure 40:
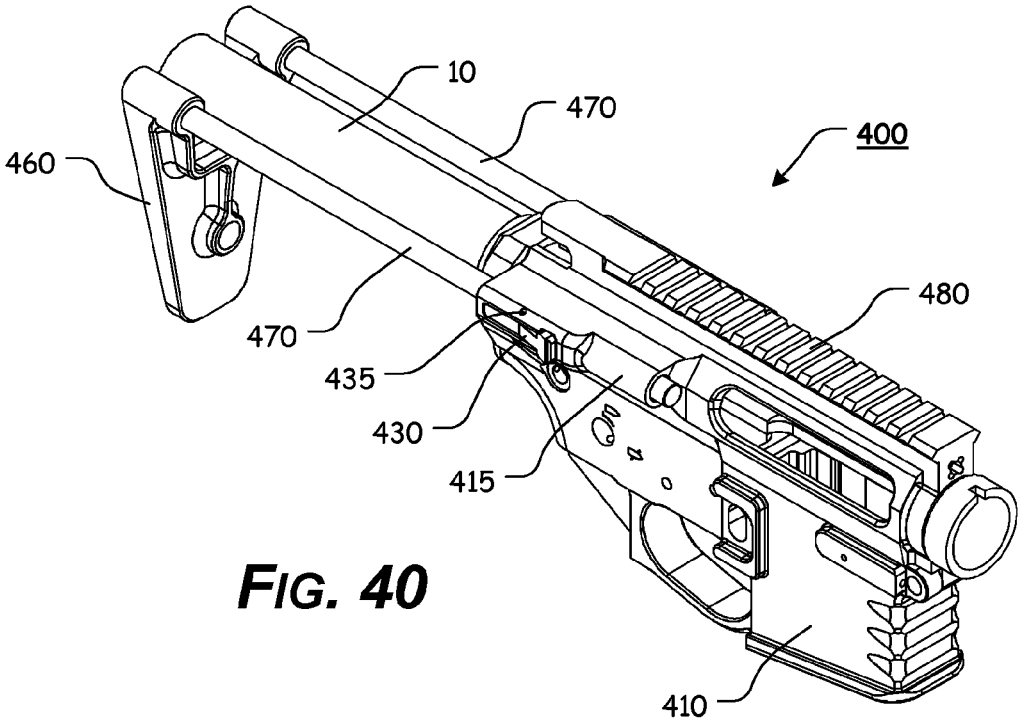
FIG. 40 illustrates an upper, right, front perspective view of an exemplary embodiment of an upper receiver and collapsible buttstock being assembled together with a lower receiver and buffer tube, according to this invention.
Figure 41:
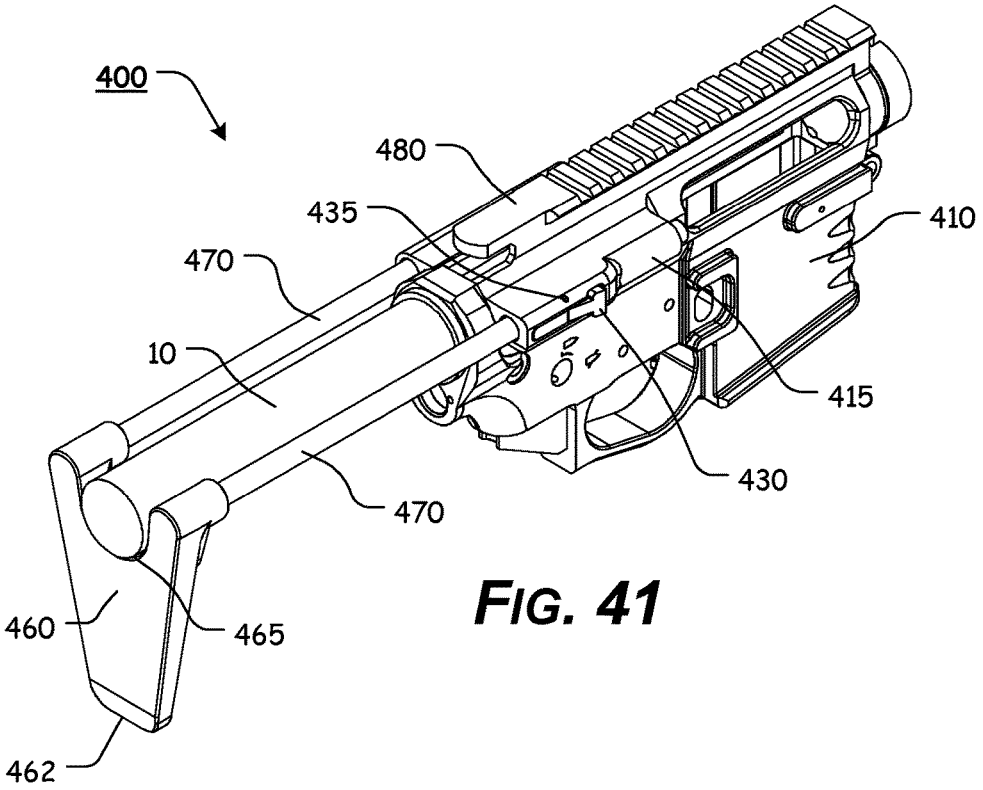
FIG. 41 illustrates an upper, right, rear perspective view of an exemplary embodiment of an upper receiver and collapsible buttstock being assembled together with a lower receiver and buffer tube, according to this invention.
Figure 42:
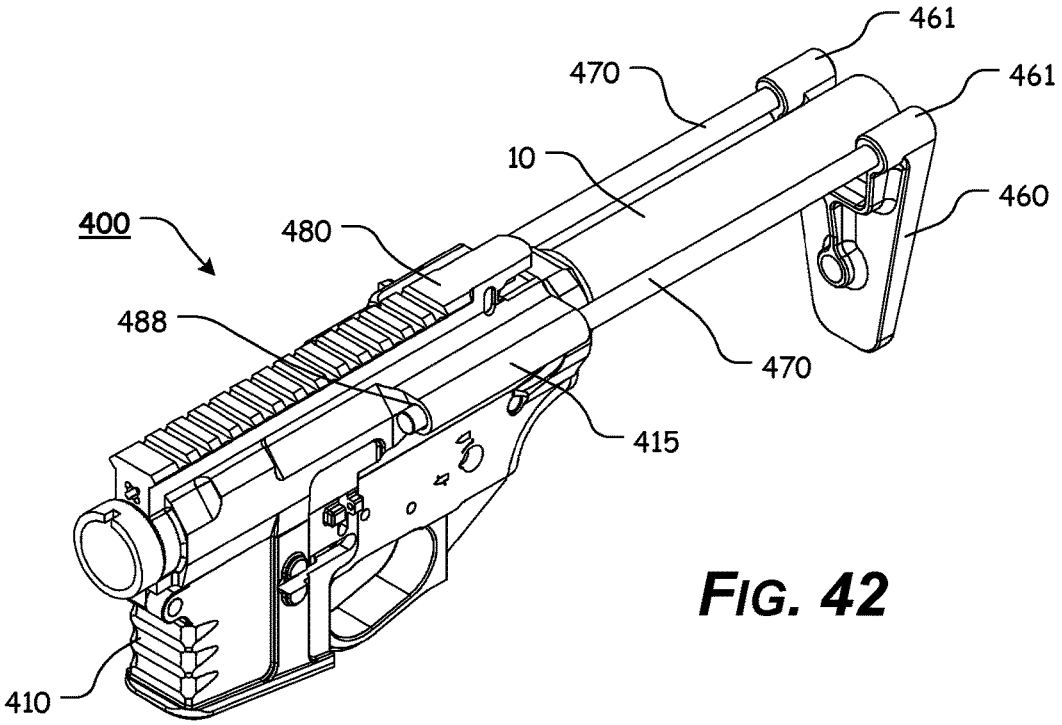
FIG. 42 illustrates an upper, left, front perspective view of an exemplary embodiment of an upper receiver and collapsible buttstock being assembled together with a lower receiver and buffer tube, according to this invention.
Figure 43:
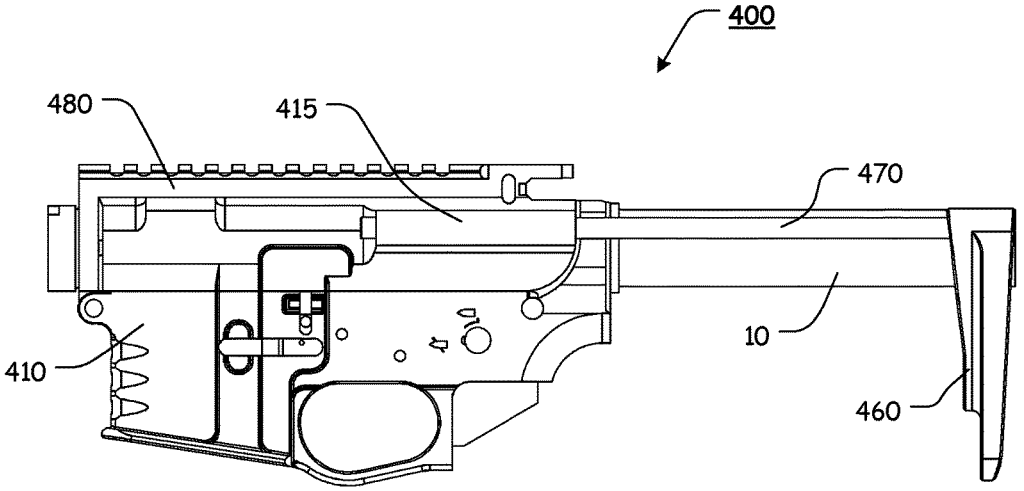
FIG. 43 illustrates a left side view of an exemplary embodiment of an upper receiver and collapsible buttstock being assembled together with a lower receiver and buffer tube, according to this invention.

FIGS. 30-31 illustrate a third exemplary embodiment of a receiver and collapsible buttstock 300 being assembled together with an upper receiver 12 and buffer tube 10.

As shown in FIGS. 30-31, the receiver and collapsible buttstock 300 comprises elements similar to those of the receiver and collapsible buttstock 100 and/or 200. However, as shown in FIGS. 30-31, the receiver 100 and/or 200 is replaced by receiver 310. The receiver 310 includes an integral stock connector component 315 that is formed higher up on the receiver 310 when compared to the location of the integral stock connector components 115 and 215.

The integral stock connector component 315 is positioned such that the extension rod/rail apertures 318 are formed outside at least a portion of the exterior wall surfaces 312 of the receiver 310, along either side of the buffer tube aperture. Thus, when assembled, the extension rods/rails 170 are located substantially alongside and coplanar to the buffer tube 10.

In this manner, the extension rods/rails 170 are aligned along either side of the bore axis of the receiver, causing the majority of recoil experienced during firing of the rifle to be directed in a substantially straight line back from the receiver, through the extension rods/rails 170, to the buttstock 160. By directing the recoil straight back, along the bore axis and along substantially coplanar components, the amount of muscle rise experienced during firing is reduced, when compared to conventional collapsible stock assemblies.

As illustrated most clearly in FIG. 30, the forward assist that is typically included on an upper receiver 12 is removed so as to allow the extension rod/rail 170, located on the right side of the receiver 12 to move along the right side of the receiver 12. In certain exemplary, nonlimiting embodiments, a recess is formed in the shell deflector of the upper receiver 12 to act as an additional stop for the extension rod/rail 170 located on the right side of the receiver 12.

FIGS. 32-44 illustrate various views of a view of an exemplary embodiment of a receiver and collapsible buttstock 400 and an upper receiver 480, according to this invention. As shown in FIGS. 32-44, the receiver and collapsible buttstock 400 comprises at least some of a lower receiver 410, an upper receiver 480, a buffer tube 10, extension rod/rails 470, and a buttstock 460.

It should be understood that the buffer tube 10, the extension rod/rails 470, and the buttstock 460 correspond generally to and operates similarly to the buffer tube 10, the extension rod/rails 170, and the buttstock 160, as described above with reference to the receiver and collapsible buttstock 100 of FIGS. 5-27.

However, as shown in FIGS. 32-44, the lower receiver 410 can be a typical for a firearm, known lower receiver. It should be appreciated that a more detailed explanation of the lower receiver 410, the standard features and elements of a lower receiver that are not related to the present invention, the buffer tube 10, instructions regarding how to assemble the upper receiver 480, the lower receiver 410, and the buffer tube 10, and certain other items and/or techniques necessary for the implementation and/or operation of the various exemplary embodiments of the present invention are not provided herein because such elements are commercially available and/or such background information will be known to one of ordinary skill in the art. Therefore, it is believed that the level of description provided herein is sufficient to enable one of ordinary skill in the art to understand and practice the present invention, as described.

As illustrated, the upper receiver 480 includes an integral stock connector component 415 that extends along a portion of the upper receiver 480, proximate either side of the buffer tube aperture. In certain exemplary, nonlimiting embodiments, the integral stock connector component 415 extends along the side walls of the upper receiver 480. Depending on the length of the stock connector component 415 formed on the right side of the upper receiver 480, the integral stock connector component 415 may replace the forward assist and/or the shell deflector of the right side of the upper receiver 480.

Two extension rod/rail apertures 488 are formed through the integral stock connector component 415, substantially parallel to the longitudinal axis $A_{LR}$ of the upper receiver 480. In certain exemplary, nonlimiting embodiments, the extension rod/rail apertures 488 are formed outside at least a portion of the exterior wall surfaces 487 of the upper receiver 480. In other exemplary, nonlimiting embodiments, the extension rod/rail apertures 488 may be formed at least partially within receiving channels formed in the exterior wall surfaces 487 of the upper receiver 480. In still other exemplary, nonlimiting embodiments, the extension rod/rail apertures 488 are formed within the integral stock connector component 415 and within the side walls of the upper receiver 480. Thus, the extension rod/rail apertures 488 may extend only through the integral stock connector component 415, may optionally extend through the integral stock connector component 415 and a portion of the exterior wall surfaces 487 of the upper receiver 480, or may optionally extend through the integral stock connector component 415 and be maintained within the side walls of the upper receiver 480.

The extension rod/rail apertures 488 are formed so as to slidably receive the extension rods/rails 470 that extend from the buttstock 460. In this manner, the extension rods/rails 470 are repeatably, slidably movable within the extension rod/rail apertures 488.

In certain exemplary, nonlimiting embodiments, the extension rod/rail apertures 488 may be at least partially internally lined with a bushing or liner element, comprising a plastic, self-lubricating plastic, or other material to reduce friction between the interior walls of the extension rod/rail apertures 488 and the exterior surface of the extension rods/rails 470.

It should also be understood that while the extension rod/rail apertures 488 (and the extension rods/rails 470) are illustrated as having a substantially circular profile, the overall shape and/or profile of the extension rod/rail apertures 488 and the extension rods/rails 470 is a design choice based upon the desired characteristics, functionality, and/or appearance of the extension rod/rail apertures 488 and the extension rods/rails 470. For example, the extension rod/rail apertures 488 and/or the extension rods/rails 470 may have a substantially circular, square, triangular, rectangular, oblong, "L" shaped, "I" shaped, "C" shaped, "V" shaped, "Z" shaped, "T" shaped, or other profile.

Furthermore, in various exemplary embodiments, the extension rods/rails 470 may be formed of a solid, hollow, or at least partially hollow portion of material.

Thus, the size and shape of the extension rod/rail apertures 488 and the extension rods/rails 470 may be altered, as desired, so long as at least a portion of the extension rods/rails 470 are able to be slidably movable within the extension rod/rail apertures 488.

As illustrated most clearly in FIGS. 39-42, the buttstock assembly comprises a buttstock 460 and two extension rods/rails 470. The buttstock 460 comprises an elongate portion of material extending from a top end 461 to a bottom end 462. A recessed channel 465 is formed in the top end of the buttstock 460. In certain exemplary embodiments, the recessed channel 465 forms an arcuate or semi-circular channel. Alternatively, the recessed channel 465 may form an alternate shape, primarily as dictated by the outer shape of the buffer tube 10.

Because of the arcuate or semi-circular shape of the recessed channel 465, the space provided within the recessed channel 465 defines an area within the buttstock 460, which allows the buffer tube 10 to freely slide therethrough.

In certain exemplary, nonlimiting embodiments, a cheek rest (not illustrated) may be permanently or releasably attached or coupled to the buttstock 460.

In various exemplary embodiments, the extension rods/rails 470 are formed of a substantially cylindrical shaped portion of material that extends from a first end to a second end. In various exemplary embodiments, the extension rods/rails 470 comprise a solid portion of material. Alternatively, the extension rods/rails 470 comprise a hollow or tubular portion of material.

In various exemplary, nonlimiting embodiments, two or more rod dimples/detents are formed along the rod channel. The rod channel and rod dimples/detents correspond to and operate similarly to the rod channel 175 and the rod dimples/detents 177, as described above with respect to the receiver and collapsible buttstock 100.

As illustrated, a first extension rod/rail 470 and a second extension rod/rail 470 are attached or coupled to the buttstock 460 so as to extend from the buttstock 460. The extension rods/rails 470 extend from the buttstock 460 so as to be aligned with and slidable within the extension rod/rail apertures 488 of the integral stock connector component 415.

The integral stock connector component 415 is positioned such that the extension rod/rail apertures 418 are formed outside at least a portion of the exterior wall surfaces 412 of the receiver 410, along either side of the buffer tube aperture. Thus, when assembled, the extension rods/rails 170 are located substantially alongside and coplanar to the buffer tube 10.

In this manner, the extension rods/rails 170 are aligned along either side of the bore axis of the receiver, causing the majority of recoil experienced during firing of the rifle to be directed in a substantially straight line back from the receiver, through the extension rod/rails 170, to the buttstock 160. By directing the recoil straight back, along the bore axis and along substantially coplanar components, the amount of muscle rise experienced during firing is reduced, when compared to conventional collapsible stock assemblies.

As illustrated most clearly in FIGS. 33, 35, 40, 41, and 44, the latch assembly comprises a latch 430 pivotably attached or coupled, via a pivot pin 435, within a latch cavity 482. The latch 430 comprises a finger button end and an engagement end and is pivotable, via the pivot pin 435, between an engaged and a disengaged position. Typically, the finger button end is divided from the engagement end proximate the pivot point.

The latch cavity 482 provides a recessed area for the latch 430. An aperture 483 is provided proximate the engagement end of the latch cavity 482, which provides access between the latch cavity 482 and the interior of the extension rod/rail aperture 488 below the latch cavity 482.

The latch 430 is typically spring biased, via a biasing element, to the engaged position. In the engaged position, a protrusion from the latch 430 protrudes through the latch cavity 482 and into the extension rod/rail aperture 488 a sufficient distance to engage and be at least partially positioned within a rod channel 475 and/or rod dimples/detent 477.

When the latch 430 is pivoted to the disengaged or unlocked position, via urging of the finger button end, the protrusion is withdrawn a sufficient distance from the extension rod/rail aperture 488 to disengage from the rod dimples/detent 477, but continue to be maintained within the rod channel 475.

Thus, through interaction of the protrusion of the latch 430 and the rod dimples/detents 477, the buttstock assembly can be releasably secured at a desired position relative to the upper receiver 480.

While the receiver and collapsible buttstock 400 is illustrated as including a single latch 430 maintained within a latch cavity 482 formed on the right side of the upper receiver 480, it should be appreciated that an additional latch 430 may be included within a latch cavity 482 formed on the left side of the upper receiver 480.

In various exemplary embodiments, various components of the receiver and collapsible buttstock 400 are substantially rigid and are formed of aluminum. Alternate materials of construction of the various components of the receiver and collapsible buttstock 400 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the receiver and collapsible buttstock 400 is a design choice based on the desired appearance and functionality of the receiver and collapsible buttstock 400.

It should be appreciated that certain elements of the receiver and collapsible buttstock 400 may be formed as an integral unit (such as, for example, the buttstock 460 and the extension rods/rails 470). Alternatively, suitable materials can be used and sections or elements made independently and attached or coupled together, such as by adhesives, welding, screws, rivets, pins, or other fasteners, to form the various elements of the receiver and collapsible buttstock 400.

It should also be understood that the overall size and shape of the receiver and collapsible buttstock 400, and the various portions thereof, is a design choice based upon the desired functionality and/or appearance of the receiver and collapsible buttstock 400.

While the receiver and collapsible buttstock 400 is illustrated and described as having two extension rods/rails 470 engaging two extension rod/rail apertures 488, it should be appreciated that the receiver and collapsible buttstock 400 may include a single extension rod/rail 470 engaging a single extension rod/rail aperture 488.

During use, the buttstock assembly may initially be presented in a retracted or collapsed position, as illustrated in FIGS. 39-44. In this position, the latch 430 is in the engaged or locked position and the protrusion portion of the latch 430 is positioned within the rod dimples/detents formed at a first terminal end 478 of the rod channel 475. The interaction of the protrusion portion protrusion portion of the latch 430, and the rod dimples/detents is sufficient to maintain the buttstock assembly in the collapsed or retracted position even if a withdrawing force is applied to the buttstock assembly.

When a user desires to extend the buttstock assembly, the user merely engages the finger button portion of the latch 430 and urges the finger button portion inward, to the disengaged or unlocked position. Because the latch 430 is at least partially positioned within the latch cavity 482, unintentional manipulation of the latch 430 can be avoided.

As the latch 430 is pivotably urged toward the disengaged or unlocked position, the protrusion portion of the latch 430 is withdrawn from the extension rods/rail aperture 488 a sufficient distance so as to be removed from the rod dimples/detents but maintained within the rod channel 475. Thus, the extension rods/rails 470 can be slidably withdrawn from the extension rail apertures 488, a distance permitted by the length of the rod channel and the rod dimple/detent positioned at the second terminal end 479 of the rod channel 475.

In certain exemplary, nonlimiting embodiments, the distance from the first terminal end 478 of the rod channel to the second terminal end 479 of the rod channel is approximately 3 inches. Alternatively, the distance from the terminal ends may be greater or less than 3 inches and may be, for example, 2-10 inches or more.

When the user no longer urges the latch 430 to the unlocked or disengaged position, the spring bias of the latch biasing elements urges the latch 430 toward the engaged or locked position, such that the protrusion portion of the latch 430 may continue to allow slidable movement of the extension rods/rails 470 until the protrusion portion of the latch 430 reaches a rod dimple/detent 477. Upon reaching a rod dimple/detent 477, the spring biasing force of the latch biasing element urges the protrusion portion of the latch 430 into the rod dimples/detents 477, thereby locking the buttstock assembly into a given position relative to the upper receiver 480.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, nonlimiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A receiver and collapsible buttstock, comprising:

a stock connector component formed in a portion of said receiver;

a buttstock extending from a top end to a bottom end and having a recessed channel formed in said top end of said buttstock;

at least one extension rod/rail extending from said buttstock, wherein a rod channel is formed along at least a portion of said at least one extension rod/rail, and wherein said rod channel includes a rod dimple/detent formed at each terminating end of said rod channel;

at least one extension rod/rail aperture formed through said stock connector component, wherein said at least one extension rod/rail aperture is formed so as to slidably receive at least a portion of said extension rod/rail extending from said buttstock;

a latch cover attached or coupled to said stock connector component, wherein said latch cover includes a latch cover cavity formed at least partially therein, wherein said latch cover cavity extends to at least one rod/rail aperture formed therethrough, wherein each rod/rail aperture is formed so as to be aligned with a corresponding extension rod/rail aperture; and a latch, wherein said latch is at least partially positioned within a portion of said latch cover cavity, wherein said latch extends from an engagement portion to a protrusion portion, wherein said latch is movable, between an engaged position and a disengaged position, wherein when said latch is in said engaged position, said protrusion portion urges at least one latch element into said rod/rail aperture so as to allow at least a portion of said at least one latch element to seat into at least a portion of said rod dimples/detents of said at least one extension rod/rail, and wherein when said latch is in said disengaged position, said protrusion portion allows said at least one latch element to retract from said rod dimples/detents so as to be at least partially received within at least a portion of said rod channel of each extension rod/rail.

2. The receiver and collapsible buttstock of claim 1, wherein a longitudinal axis of each at least one extension rod/rail aperture is substantially parallel to a longitudinal axis of said receiver.

3. The receiver and collapsible buttstock of claim 1, wherein said stock connector component is formed in said receiver such that at least a portion of said at least one extension rod/rail aperture is formed below a buffer tube attachment aperture of said receiver.

4. The receiver and collapsible buttstock of claim 1, wherein each rod channel includes one or more rod dimples/detents formed along at least a portion of said rod channel.

5. The receiver and collapsible buttstock of claim 1, wherein said at least one extension rod/rail aperture is formed outside at least a portion of an exterior wall surface of said receiver.

6. The receiver and collapsible buttstock of claim 1, wherein said at least one extension rod/rail aperture is formed at least partially within a receiving channel formed in an exterior wall surface of said receiver.

7. The receiver and collapsible buttstock of claim 1, wherein said at least one extension rod/rail aperture is formed within said stock connector component and within at least a portion of a side wall of said receiver.

8. The receiver and collapsible buttstock of claim 1, wherein said at least one extension rod/rail aperture is internally lined with a plastic, self-lubricating plastic, or other material to reduce friction between an interior wall of said extension rod/rail aperture and an exterior surface of said at least one extension rod/rail.

9. The receiver and collapsible buttstock of claim 1, wherein said at least one extension rod/rail aperture and said extension rod/rail has a substantially circular, square, triangular, rectangular, oblong, "L" shaped, "I" shaped, "C" shaped, "V" shaped, "Z" shaped, "T" shaped profile.

10. The receiver and collapsible buttstock of claim 1, further comprising a cheek rest that extends from a first end to a second end, wherein said cheek rest is permanently or releasably attached or coupled to said buttstock atop said top end of said buttstock, proximate said first end of said cheek rest, and wherein an aperture is defined between said recessed channel of said buttstock and an interior surface of said cheek rest, which allows a buffer tube to freely slide therethrough.

11. The receiver and collapsible buttstock of claim 10, wherein said cheek rest comprises a substantially inverted "U" or "V" shaped portion of material.

12. The receiver and collapsible buttstock of claim 1, wherein said at least one extension rod/rail comprises a solid portion of material.

13. The receiver and collapsible buttstock of claim 1, wherein said at least one extension rod/rail comprises a hollow or tubular portion of material.

14. The receiver and collapsible buttstock of claim 1, wherein each rod dimple/detent represents a lockable position of said buttstock relative to said receiver.

15. The receiver and collapsible buttstock of claim 1, wherein said at least one latch element comprises a spherical ball, a cylindrical portion of material, a protrusion portion, or a rectangular latch.

16. The receiver and collapsible buttstock of claim 1, further comprising at least one biasing element positioned between said latch and an interior surface of said latch cover cavity, so as to bias said latch to said engaged position.

17. A receiver and collapsible buttstock, comprising: a stock connector component formed in at least a portion of said receiver, a buttstock; at least one extension rod/rail extending from said buttstock, wherein a rod channel is formed along at least a portion of said at least one extension rod/rail, and wherein said rod channel includes a rod dimple/detent formed at each terminating end of said rod channel; at least one extension rod/rail aperture formed through said stock connector component, wherein said at least one extension rod/rail aperture is formed so as to slidably receive at least a portion of said extension rod/rail extending from said buttstock; a latch cover, wherein said latch cover includes a latch cover cavity formed at least partially therein, wherein said latch cover cavity extends to at least one rod/rail aperture formed therethrough, wherein said at least one rod/rail aperture is formed so as to be aligned with a corresponding extension rod/rail aperture; and a latch, wherein said latch is at least partially positioned within a portion of said latch cover cavity, wherein said latch extends from an engagement portion to a protrusion portion, wherein said latch is movable, between an engaged position and a disengaged position, wherein when said latch is in said engaged position, said protrusion portion urges at least one latch element into said rod/rail aperture so as to allow at least a portion of said at least one latch element to seat into at least a portion of said rod dimples/detents of each extension rod/rail, and wherein when said latch is in said disengaged position, said protrusion portion allows said at least one latch element to retract from said rod dimples/detents so as to be at least partially received within at least a portion of said rod channel of said at least one extension rod/rail.

18. The receiver and collapsible buttstock of claim 17, further comprising a cheek rest attached or coupled to said buttstock, and wherein an aperture is defined between a recessed channel of said buttstock and an interior surface of said cheek rest, which allows a buffer tube to freely slide therethrough.

19. A method for manipulating a collapsible buttstock attached or coupled to a receiver, wherein said receiver comprises: a stock connector component formed in at least a portion of said receiver; a buttstock; at least one extension rod/rail extending from said buttstock, wherein a rod channel is formed along at least a portion of said at least one extension rod/rail, and wherein said rod channel includes a rod dimple/detent formed at each terminating end of said rod channel; at least one extension rod/rail aperture formed through said stock connector component, wherein said at least one extension rod/rail aperture is formed so as to slidably receive at least a portion of said extension rod/rail extending from said buttstock; a latch cover, wherein said latch cover includes a latch cover cavity formed at least partially therein, wherein said latch cover cavity extends to at least one rod/rail aperture formed therethrough, wherein said at least one rod/rail aperture is formed so as to be aligned with a corresponding extension rod/rail aperture; and a latch, wherein said latch is at least partially positioned within a portion of said latch cover cavity, wherein said latch extends from an engagement portion to a protrusion portion, wherein said latch is movable, between an engaged position and a disengaged position, wherein when said latch is in said engaged position, said protrusion portion urges at least one latch element into said rod/rail aperture so as to allow at least a portion of said at least one latch element to seat into at least a portion of said rod dimples/detents of said at least one extension rod/rail, and wherein when said latch is in said disengaged position, said protrusion portion allows said at least one latch element to retract from said rod dimples/detents so as to be at least partially received within at least a portion of said rod channel of said at least one extension rod/rail; said method comprising: urging said latch from said engaged position; manipulating said buttstock; and allowing said latch to return to said engaged position.

20. The method of claim 19, wherein said step of allowing said latch to return to said engaged position further comprises allowing at least one biasing element positioned between said latch and an interior surface of said latch cover cavity to bias said latch to said engaged position.

* * * * *